US007073218B2

(12) United States Patent
Polevoy et al.

(10) Patent No.: US 7,073,218 B2
(45) Date of Patent: Jul. 11, 2006

(54) SUPPORT MEMBER AND SYSTEM FOR AFFIXATION TO BED RAILS OR BED FRAME

(75) Inventors: Richard S. Polevoy, Teaneck, NJ (US); Howard Scott Ryan, Skaneateles, NY (US); Paul Eric Carlson, Skaneateles, NY (US)

(73) Assignee: Finger Lakes Intellectual Property, LLC, Teaneck, NJ (US)

( * ) Notice: Subject to any disclaimer, the term of this patent is extended or adjusted under 35 U.S.C. 154(b) by 4 days.

(21) Appl. No.: 10/632,512

(22) Filed: Aug. 1, 2003

(65) Prior Publication Data

US 2004/0093670 A1 May 20, 2004

Related U.S. Application Data

(63) Continuation-in-part of application No. 09/518,320, filed on Mar. 3, 2000, now Pat. No. 6,625,827.

(51) Int. Cl.
*A47C 19/02* (2006.01)

(52) U.S. Cl. ..... 5/201; 5/203; 5/207; 5/238; 5/286

(58) Field of Classification Search ..... 5/201, 5/203, 200.1, 204, 206, 207, 236.1, 238, 5/279.1, 282.1, 285, 280
See application file for complete search history.

(56) References Cited

U.S. PATENT DOCUMENTS

| | | | | | |
|---|---|---|---|---|---|
| 115,485 | A | * | 5/1871 | Lallay | 5/305 |
| 257,741 | A | * | 5/1882 | Morris | 5/238 |
| 277,541 | A | * | 5/1883 | Bowers | 5/238 |
| 434,132 | A | * | 8/1890 | Howell | 5/238 |
| 553,769 | A | * | 1/1896 | Watkins | 5/238 |
| 557,997 | A | * | 4/1896 | Nessel | 5/238 |
| 587,864 | A | * | 8/1897 | Ryan et al. | 5/236.1 |
| 609,703 | A | * | 8/1898 | Richardson | 5/238 |
| 989,446 | A | * | 4/1911 | Thompson | 5/202 |
| 2,492,070 | A | * | 12/1949 | Stone et al. | 5/238 |
| 2,595,321 | A | * | 5/1952 | Anderson | 5/238 |
| 4,536,904 | A | * | 8/1985 | Whitehead | 5/201 |
| 4,567,615 | A | * | 2/1986 | Fanti | 5/191 |
| 4,745,644 | A | * | 5/1988 | Pottschmidt | 5/200.1 |

FOREIGN PATENT DOCUMENTS

| | | | |
|---|---|---|---|
| EP | 0009002 | * | 3/1980 |
| FR | 2549912 | * | 2/1985 |

* cited by examiner

*Primary Examiner*—Alexander Grosz
(74) *Attorney, Agent, or Firm*—Klauber & Jackson

(57) ABSTRACT

A cross member that can be used with a bed frame or bed rails to provide support for a box spring and mattress. The cross member is attachable to the side rail of the bed by a snap-in system where the ends of the cross member are comprised of slide ends that interfit into receptacles located along the side rails. A leg is used to support a bed frame member that is self adjusting by a mechanism that can be unlocked by a person to drop the leg downwardly by gravity to contact the floor and is then lockable in that extended length.

37 Claims, 25 Drawing Sheets

SUPPORT MEMBER AND SYSTEM FOR AFFIXATION TO BED RAILS OR BED FRAME

REFERENCE TO RELATED CASES

This patent application is a Continuation-In-Part application based upon and claiming priority of U.S. Patent Application, U.S. Ser. No. 09/518,320, filed Mar. 3, 2000 , now U.S. Pat. No. 6,625,827, issued Sep. 30, 2003, and entitled UNIVERSAL TENSION SPRING SUPPORT MEMBER FOR BED RAILS OR BED FRAME.

BACKGROUND

This invention relates generally to a support assembly for a frame or rail assembly to connect a headboard and a footboard and, ultimately to support a mattress and box spring, and, more particularly, to an improved universal cross member support for a bed frame or bed rails.

Bed frames or bed rails are widely used to provide a support for the box spring and mattress and are of a relatively straightforward construction comprising a rectangular or square frame. In the case of bed rails, there are normally side rails that are wooden, rolled formed metal or angle iron and which connect to a headboard and a footboard. The side rails, the headboard and the footboard are interconnected so that the overall unit may be readily assembled and the unit is of predetermined dimensions so as to accept a standard box spring that is seated upon the frame.

Originally, the side rails would support laterally placed wooden bed slats that would cross the bed frame and support the box spring. Such wooden slats were strong enough to provide the necessary support to the box spring, however, they were generally troublesome, somewhat weak and were cumbersome to install and maintain in place, and required screws for assembly, particularly when moving the bed from one location to another. It was necessary to cut each slat to the particular width or space between the bed rails and the construction relied on the weight of the box spring and mattress to keep the slats in place.

As an alternate, therefore, there are currently used, one or more cross members that are constructed of steel angle iron and normally are L-shaped and are placed laterally across the frame spanning the side rails. Thus, as an improvement, the steel cross members replaced the wooden slats which made the consequent set up, construction and transportability considerable easier and the overall construction stronger. In addition, metal supports have also been used in conjunction with the wooden slats. Obviously, the steel cross members could be constructed of very heavy gauge steel so that adequate support could be provided for the box spring and mattress, however, the use of heavy gauge steel increases the cost of the cross member and additionally, adds to the overall weight of the structure. Therefore, although constructed of steel, the present cross members alone are not sufficient to provide the necessary amount of support for the box spring and mattress.

Thus, virtually all bedding manufacturers require the use of a rigid center support for the cross member, whether the construction is a bed frame or bed rails in order to insure the structural integrity of the box spring to prevent damage to that component. The use of such a rigid center support virtually precludes the use of a typical wooden slat or typical angle iron cross member without the use of a leg assembly that actually contacts the floor for the needed support to the cross member. Accordingly to solve the problem of a lack of adequate support, manufacturers universally turned to the use of a leg that relied on contact with the floor to add that support. An example of such solutions is shown in U.S. Pat. No. 5,502,852 of Fredman et al; U.S. Pat. No. 5,815,860 of Mitchell and U.S. Pat. No. 5,894,614 of Stroud.

It therefore became necessary to add a glide or glides to the leg of the steel cross member that spanned between the side rails to provide sufficient support to the cross member. The glide is generally affixed to a leg depending downwardly from the cross member and, in turn, the glide contacts the floor with a flat, planar bottom surface so that the cross member is supported on the floor and thus gives crucial support to the box spring and to the other components of the assembled bed. It should be noted, that while the glide is referred to as having a flat, planar bottom surface, that surface is an effective flat surface as the bottom of the glide may have its inner portion displaced upwardly such that the entire bottom surface is not really totally flat and planar. If totally flat, the tolerances would be considerably strict and thus, normally only an effective flat planar surface is formed in the bottom of such glides.

Obviously, with the use of a leg and glide to support the cross member, it is important that the overall length of the glide assembly, that is, the glide and the leg, be fairly precise with respect to the cross member. If the length of the glide assembly is too short, there is inadequate support for the cross member and the cross member will bow downwardly under the weight of the box spring until the necessary contact between the glide, and the floor is established. If, on the other hand, the length of the glide assembly is too long, it causes the cross member to bow upwardly. In either case, the result is undesirable and can cause structural damage to the cross member and possibly to the box spring.

It is therefore necessary that the glide assembly be of the proper height and to that end, the glide itself is normally threadedly affixed to the leg so that the glide can be simply rotated by the user to raise and lower the glide to arrive at the proper desired height. The need for the adjustment is paramount in that the headboard and footboard, if there is one, is not a standard industry height above the floor and thus, the height of the frame and the side rails off the floor will differ from bed to bed so that a fixed height glide assembly would not be suitable to fit all beds universally. In addition, the bed may, from time to time, be moved about the room and the glide need to be readjusted due to irregularities in the floor itself to correct for high and low spots of the floor.

A further example of a cross member is shown and described in U.S. Pat. No. 4,080,674 of Fredman where the cross member includes a pair of supporting legs each of which have a vertically adjustable glide to insure that the cross member is adequately supported by the flooring without twisting or misalignment. Again, as explained, the solution is founded upon a reliance upon the floor to adequately support the center member.

Other examples of devices or vertically adjustable legs are shown and described in U.S. Pat. No. 5,502,852 of Fredman et al; U.S. Pat. No. 5,815,860 of Mitchell and U.S. Pat. No. 5,894,614 of Stroud, all of which have some means of adjusting the vertical length of a leg so that the overall bed frame can utilize the floor for support.

Typically, therefore, the glide has an upwardly extending threaded stem that mates with a corresponding threaded opening in the leg located in the desired position. The stem itself is generally small in diameter, about one quarter to one half inch diameter, for most applications, and its support in the leg is relatively secure and sufficiently strong for use as a support for the cross member when in place, i.e encountering compressive forces, however the overall glide assembly is not particularly strong when subjected to side forces and opened to the full extension of height.

Accordingly, when the headboard and footboard are moved from one location to another, such as for cleaning under the bed, and particularly when the box spring and the mattress are in position upon the bed frame, the glide drags on the floor as the bed is moved. Where the floor is covered, for example, with carpeting, the dragging causes twisting of the glide assembly and can easily lead to a breaking of the leg from the cross member and/or ever damage to the box spring.

Too, the cross member is, as indicated, generally a steel L-shaped member and is easily twisted through the influence of a bending of the glide member so that damage to the cross member is a good possibility. Added to that weakness, is the fact that many cross members are coupled together at the center point between the two side rails, that is, the cross member is generally extended in two sections inwardly from the side rails and is coupled together at or near the center of the span between the side rails by some clamp or other coupling device to compensate for the varying widths of the headboards and footboards.

Thus, the center of the span between the supporting side rails is already a vulnerable spot where the cross member is weak, however, adding to that weakness is the use of a coupling at that center spot where the two individual cross member are joined together by a clamp. In short, the glide assembly that supports the cross member is in a most vulnerable position with respect to being damaged or to damaging the cross member and the box spring by the user moving it from one location to another or by simply having the height adjustment incorrectly set.

Obviously for the user or installer, this is a severe problem as it creates the necessity to obtain another bed rail or support system as the breaking of a leg is generally not repairable since the components are stamped metal parts that are riveted together. It would certainly be advantageous to avoid the problem altogether so that the bed frame is not subject to the breakage problem herein outlined.

Another problem exists in the construction of a cross member in that the actual width or span between the side rails may have a variance and thus there may need to make an adjustment in the length of the cross member to insure that it properly aligns with the particular fitting or bracket in the side rails. The difficulty is particularly significant where the cross member is assembled by fitting into brackets or the like in the side rails as the length must be accurate to make the proper fitting possible. Thus, presently there are many ways to attach the cross members to a side rail that are non-standard devices.

Accordingly, it would be advantageous that the length of the cross member be designed so as to be adjustable to make certain its assembly to the side rails can be made easily and accurately. An attempt at solving that problem is shown in the aforementioned disclosures of U.S. Pat. No. 5,502,852 of Friedman et al; U.S. Pat. No. 5,815,860 of Mitchell and U.S. Pat. No. 5,894,614 of Stroud. However, again, the center of the cross member is already the weakest area of the cross member and the addition of a sliding connection at that point adds to the weakness of the cross member. It would be advantageous to allow the cross member to have a width adjustment without detracting from the overall integrity of that cross member.

SUMMARY OF THE INVENTION

In accordance with the present invention, there is provided a cross member that may be used with a bed frame or bed rails and which overcomes the aforedescribed difficulties of current cross members. In the present invention, a cross member is described that is a universal cross member, that is, the cross member can be used in almost all applications where a cross member is needed and can be adapted for use with current bed frames and bed rails as well as to newly manufactured bed frames and rails.

With the universal cross member of the present invention, the need for a support glide or caster to support the cross member is, in almost all instances, eliminated such that the cross member does not require any support that contacts the floor beneath the cross member. Accordingly, the need for some initial setting and constant readjustment of the height of such a support component is eliminated along with the consequent problems associated therewith and previously described. In addition, due to the unique construction of the present universal cross member, the gauge of the steel used can still be a relatively light gauge and not a heavy steel component.

As another feature of the present universal cross member, the length of the universal cross member is adjustable such that the present universal cross member can be adjusted to account for differences in the distance between the bed rails. That length adjustment is provided at the ends of the universal cross member and not in the center area of the universal cross member so that the structural integrity of the universal cross member is not compromised. The length adjustment is provided by the use of slides, generally of a metal material and which has ends that are preferably constructed of an injection molded plastic material i.e. a glass filled nylon composition, and therefore a relatively inexpensive material that can be molded to a variety of configurations.

Accordingly, as will be seen, therefore, the present universal cross member can be used in a wide variety of bed rails and is suitable for any height of the legs of the headboard or other component since there is normally no center support that must be in contact with the floor and additionally, the length is adjustable so that the present universal cross member can be used with differing distances between the side rails.

The universal cross member of the present invention includes a generally straight member, preferably tubular, that is caused to be put in tension such that there is an upward force generally located at the center of the straight member and acting in a direction opposite to the force created by the weight of the box spring, mattress and other items that make up the completed bed so that no contact with the floor is necessary. As such, therefore, the present universal cross member can be used in almost any application and can provide the added strength and rigidity to the bed frame without the problems associated with a support that is in contact with the floor.

The principle of the present invention and its ability to provide support without actual contact with the floor is based upon a support beam that is positioned between two fixed points. When a load is added to the center of the beam acting in a downward direction, the beam will deflect downwardly after a certain amount of weight is added and the deflection will increase as additional load is added to the beam. With the present invention, the use of the tension member is used to reinforce that center and the tension member diverts the force caused by the weight outwardly much closer to the fixed end points of the beam. The diverted force is thus acting on a more supported area because those points are nearer to the fixed end points. In effect, the force acting downwardly in the center of the beam is diverted to other points at or near the ends of the beam and the beam deflection is reduced with the present invention upon imposition of the same load as a normal beam.

As sometimes used herein, the term tension member, as will be seen, is preferably a metal steel strap, however, that tension member may also be referred to as a tension bar and may be a cable, strap, bar, wire or other component, it only being important that the tensile strength of the tension member be sufficient to carry out its intended purpose in accordance with the present invention and must be of a material and of sufficient dimensions so as to provide the required amount of tension on the straight member.

In the present invention, the straight member can be formed in a variety of cross sectional shapes that generally have a symmetrical cross section and preferably in the form of a tubular steel member of a rectangular, preferably square shape. The weight of the box spring, mattress and the like acts downwardly on a surface of the straight member so, to counter that force, a force is exerted against a surface of the straight member on an opposite surface of that straight member and which acts in an opposite direction to the downwardly directed force created by the box spring and other components, thus, acting to counter the downward force with an upwardly directed force. That upward force is applied generally in the vicinity of the center of the straight member.

To create the upward force, a force transmitting means is located in the vicinity of the center of the straight member and a tension bar extends from the force transmitting means to the affixed to the straight member at locations at or near the ends of the straight member. That tension bar may take the form of a steel strap in the preferred embodiment.

As will be seen, the force transmitting means may be a solid block of material, i.e. a metal stamping or a casting, or a molded plastic component, it only being important that the force transmitting means transmit the force from the tension bar or strap to the straight member. The tension bar is maintained in tension so as to create the force that acts upwardly on the straight member tending to bow the center of the straight member upwardly and pull the ends of the straight member inwardly and downwardly.

To create that tension, the tension bar is in contact with the force transmitting means and also has its ends affixed to the straight member, preferably at points at or near the ends of he straight member. A tension means may be provided, in one embodiment that creates tension in the tension bar and which, in turn applies the force to the force transmitting means and thus to the straight member. One such tension means may be a mechanism that actually pulls or stretches the tension bar by applying a force at one or both ends of the tension bar in a direction outwardly from the center of the tension bar, or if more than one tension bar is employed, the pulling or stretching is in a direction outwardly from the point of contact with the force transmitting means. Again, as the tension member is stretched, its tendency is to straighten, however, since the center of the tension bar is displaced a finite distance from the center of the straight member by the force transmitting means, in trying to straighten the tension member, a force is created upwardly against the center of the straight member and the ends of the straight member are pulled inwardly and downwardly tending to create a slight bow in the tubular bar counter to the direction of the weight applied by the box spring, mattress and the like.

In one embodiment, the tension means comprises a flange through which the tension bar passes and the flange is affixed to the ends of the straight member. In that embodiment, the ends of the tension bar are threaded and nuts are affixed on to those threaded ends. Thus, by rotating the nuts on the ends on the tension bar, the tension imposed on that bar can be adjusted at will.

A more preferred means of maintaining tension in the tension bar is to employ a steel strap that is affixed to the straight member at or near the ends thereof and which is initially put in tension and then secured to the straight member so as to keep that tension in the strap. In the more preferred strap, the edges of the metal strap are rolled inwardly so as to add to the strength of the strap itself as well as to eliminate the otherwise relatively sharp edges of the steel strap.

In the preferred embodiment, the straight member is a rolled steel bar of a rectangular cross section and the tension bar is a steel strap that contacts the force transmitting means located at the approximate center of the straight member. The ends of the steel strap are riveted to the rolled steel bar at or near the ends of the bar and the strap is thus maintained in tension. In an ideal construction, straight member has its center portion bowed slightly upwardly in the direction toward the load to be imposed on the straight member as the steel strap is riveted to the straight member. As such, when released from the bowed configuration, the center portion returns to a straightened configuration, thus pulling the ends of the straight member upwardly to inherently create a pulling effect on the tension member to create a tension in that member. The force transmitting means is, as explained, thus simply the application of tension to the steel strap and then affixing the strap to the straight member while retaining the steel strap in tension. In the preferred embodiment, the tension causes just a slight bow in the tubular bar such that its center bows upwardly slightly in the direct of the box spring and, of course, the upward bow is opposite to the direction of the forces exerted downwardly by the box spring and other components of the completed bed.

In an ideal manufacturing process, the tension member may be just taut, that is, there is in reality a zero tension initially on the tension member but that tension is immediately created upon the imposition of a load on the straight member to create the tension when the universal cross member is employed to support a load directed downwardly on the straight member. Unfortunately, it imposes extremely close tolerances on the manufacturing process to create a taut, zero tension in the tension member of a completed universal cross member such that it is more preferable to deliberately create the pre-tension by retaining a slight owing of the straight member.

In summary, therefore, during the normal, preferred construction of the universal cross member, the tension bar is deliberately put in tension a predetermined amount and which forces a generally centrally located block or spacer upwardly to cause an upward force on the straight member such that the straight member is caused to assume a slightly bowed position.

In the manner described, the use of a additional support or supports for the straight member of the present invention that provide support from the floor to the universal member can be fully eliminated, thus the bed frame can be of any height from the floor, there being a minimum distance from the floor in order to provide the physical space for the universal cross member itself, and no adjustment needed to any support for the universal cross member. Accordingly, while the present invention is suited for most beds for use without any added center support using a floor engaging device, there may be instances where such a center support or even other supports need be added as a supplement. Such instance could occur, as an example, where the bed is a water bed where the normal loading is heavy or where there is simply an unusually heavy load applied to the bed. In such instances a molded plastic support can be provided that also serves to hold a leg. Again, in the preferred embodiment, the molded plastic support can serve to transfer the force from the tension steel strap to the straight member and, at the same time, can serve to contain a leg that can be set to a length so as to reach the floor for the needed support.

In the more preferred embodiment the leg, when used, may be affixed to the molded plastic support so as to be self adjusting, that is, the leg can conveniently be affixed to the molded plastic support by means of a mechanism that allows the user to simply drop the leg by gravity to reach the desired length touching the floor and retained firmly in that position. That automatic vertical leg adjustment is particularly advantageous since no measuring is necessary nor is there any need to rotate and screw in or out each leg to adjust each leg individually. For example with a water bed, there are normally nine legs that are positioned about the underside of the water bed to support the bed from the floor. Therefore, in the installation and set-up of such a bed, it has been necessary for the person carrying out the installation, to individually make a vertical adjustment by screwing down and balancing each of the nine legs to make sure each leg is in the proper contact with the floor. With the present, self vertically adjusting legs, the legs do not require the individual attention and can easily be automatically adjusted for the particular floor by simply releasing the leg to have it drop by gravity to a correct vertical height in proper contact with the floor. The legs therefore automatically lock into the desired position when they reach contact with the floor.

In order to optimize the efficiencies in manufacturing, the molded plastic support may be moved or located at a variety of positions along the length of the straight member as desired by the user and as dictated by the particular load imposed upon the cross member. Additionally, there may be more than one support used and each may be manufactured identically when a leg is utilized or not utilized or whether one or more legs are utilized.

As a further feature of the present invention and the applicability of the universal cross member, an improved means is provided to affix the universal cross member to the side rails, whether such side rails are wooden rails, an angle iron rail, a rolled tubular construction or other special configuration. Accordingly, in this aspect of the present invention, a specially shaped and configured slide end of the universal cross member is used and which has normal holes to enable the user to use screws to fasten the slide end to a wooden side rail or, as another alternative, the slide end has a shape that enables it to be easily snapped into a rail connector that is also specially configured to receive the slide end.

That rail connector can be a plastic molded part and which also has the versatility to be affixed to a steel angle iron side rail or custom roll formed metal rail by means of metal clips or to be insert into a gouged portion of a wooden side rail, or even be installed on an existing roll formed rail constructed in accordance with U.S. Pat. No. 4,745,644 of Pottschmidt. Further, the rail connector can be factory installed by the manufacturer as a fixed part of the side rail or, can be installed by the person setting up the bed.

There also may be a variety of specially constructed support brackets that enable the affixation of the universal cross member, or for that matter, other cross members, to a wooden side rail in order to accommodate different systems of such affixation and, in one embodiment, there may be a folded metal bracket itself that is affixed to the wooden side rail to form a receptacle for snap fitting a slide end of a cross member therein. With the specially constructed brackets, they may be individually utilized or, alternatively, they may be elongated versions that provide a plurality of receptacles to accept a plurality of cross members and, as such, not only serve to complete the snap in affixation of the cross member to a wooden side rail but also to strengthened the wooden side rail itself.

Accordingly, the use of an elongated support bracket strengthens the wooden side rail and brings about certain advantages. Since many side rails are affixed to a headboard and/or footboard by hooks extending outwardly from the ends of the side rails that interfit with pins in the headboard and footboard, it is advantageous that the downward force on the side rails be as nearly a vertical downwardly force as possible. With the normal flexure of wooden side rails, that material being only semi-rigid, the side rails bow downwardly and pull the headboard and footboard inwardly and add considerable stress to the hook and pin connection between the side rail and the footboard and headboard. By adding an elongated metal strengthening bracket to the interior surface of the side rails, that flexure is greatly reduced or effectively eliminated and the side rail becomes more rigid with less likelihood that the footboard and headboard will be pulled inwardly. As such, the addition of strengthening elongated brackets to the inside surface of side rails is an advantageous feature of the present invention in prolonging the life of the bed frame itself.

In the preferred embodiment, the slide end is simply snapped into the rail connection and thus can be readily installed by a person setting up the bed without the need for any tools such that the time required for assembly of the bed is greatly reduced and can be carried out by the user in the home. The actual connection between the slide connector and the rail connector is preferably such that the snap-in procedure is simple to join those components together, without the use of any tools, however, the completed connection cannot easily be detached so that the connection is sure and positive and, preferably, cannot be disconnected without the use of tools. Thus, once installed, the universal cross member of the present invention is solidly affixed to the particular side rail and is not easily dislodged but can only be removed by quite deliberate positive action by the user. As such, no tools are necessary to carry out the assembly of the bed when the rail connector of the present invention is installed on the side rails.

Other features of the universal cross member of a bed frame or bed rails will become more apparent in light of the following detailed description of a preferred embodiment thereof and as illustrated in the accompanying drawings.

DETAILED DESCRIPTION OF THE INVENTION

Figure 1A:
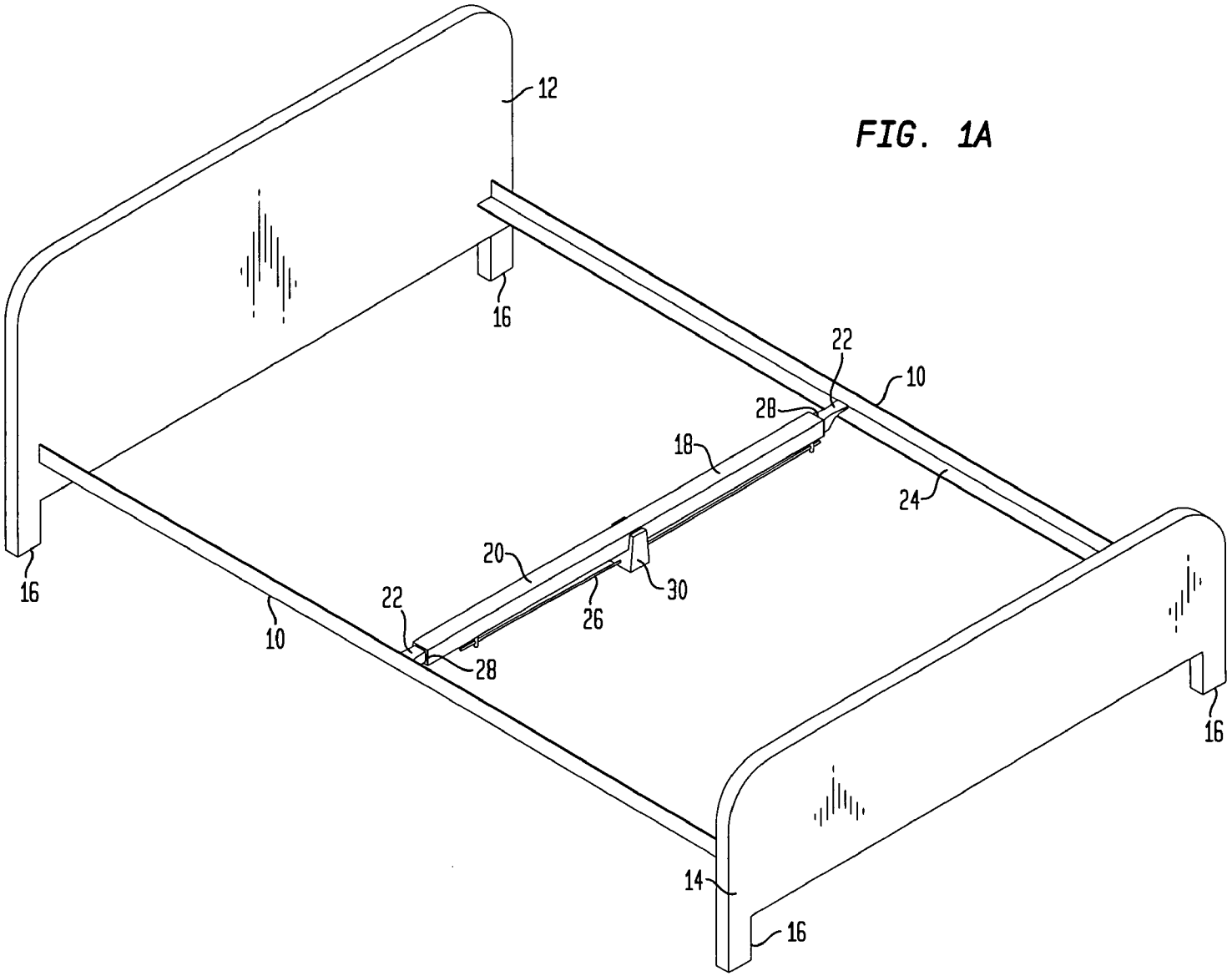
FIG. 1A is a perspective view of a completed bed assembly having as its cross member, a universal cross member constructed in accordance with the present invention.

Referring now to FIG. 1A, there is shown a perspective view of a completed bed assembly and which includes conventional components such as side rails 10 that are positioned parallel to each other and spaced apart a predetermined distance depending upon the type of box spring and mattress to be used with the bed assembly. At one end of the side rails 10, there is a headboard 12 generally affixed in normal means to the side rails 10 and at the opposite ends of the side rails 10, there is a footboard 14 that is, again, affixed to the side rails 10 in any conventional manner.

As will be noted, the typical bed assembly may or may not include both a headboard and a footboard, and those components are both shown for convenience in illustrating the present invention. It should be noted, however, that the headboard 12 and the footboard 14 both are provided with legs 16 and which support the entire bed assembly on the surface of a floor. The particular length of the legs 16 is not a standard length in the industry, however, and thus the height above the floor of the side rails 10 can vary from bed to bed depending upon the design of a particular headboard and footboard. As will become clear, the disparity in the length of legs of headboards and footboards makes the present invention applicable for use with any height of the side rails from the floor, above a minimum height, and is thus a major advantage over the current bed rail assemblies.

Continuing with FIG. 1, therefore, there is also shown a universal cross member 18 that spans the distance between the two side rails 10 to provide support for the box spring and the mattress that are positioned atop the side rails 10 and the universal cross member 18. Briefly, the universal cross member 18 is constructed with a straight member 20 that may be of a rectangular, but may be of any symmetrical cross section including a hexagon, or even a circular cross section. Non-symmetrical cross sections could be feasibly, however, such shapes are more difficult in providing the upwardly directed force to act oppositely to the downwardly acting force created by the weight of the box spring and mattress. Slidably received within the straight member 20 are a pair of end brackets 22 that are used to affix the ends of the straight member 20 to the side rails. The end brackets 22 rest on and are affixed to a horizontal surface 24 provided on the side rails 10 and which may be a wood ledge or a horizontal leg of a metal angle iron.

Briefly, the other components shown in FIG. 1A include a tension bar 26 that is affixed to the straight member 20 at or near the ends 28 of the straight member 20 and a block 30 generally located in the center of the universal cross member 18 and positioned to rest against the straight member 20 and is designed to transmit a force from the tension bar 26 to the central section of the straight member 20.

Figure 1B:
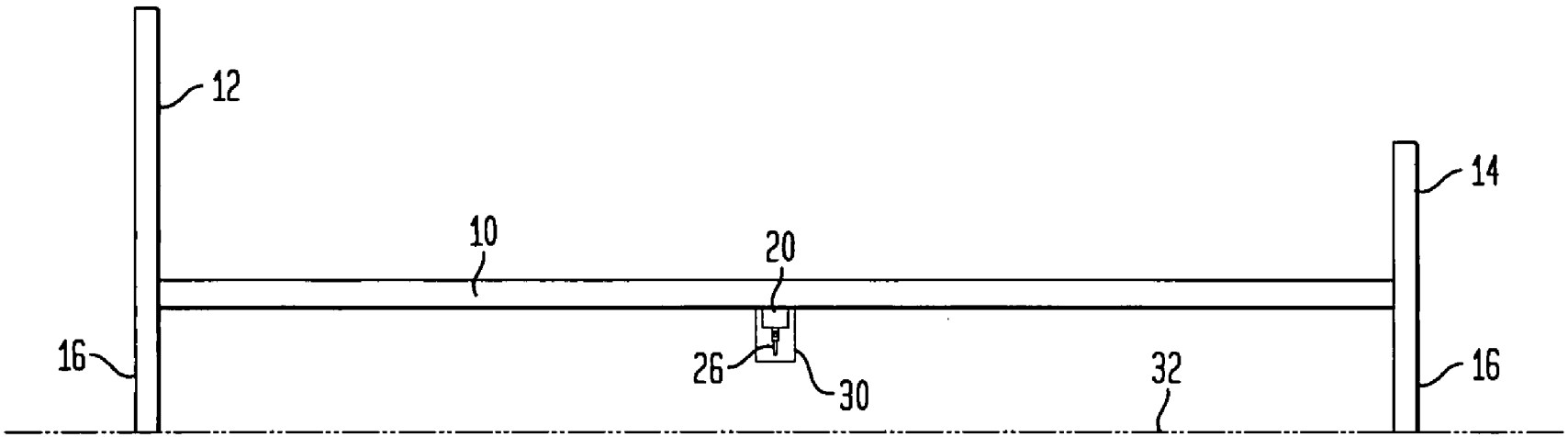
FIG. 1B is a side plan view of the bed assembly of FIG. 1A.

Turning briefly to FIG. 1B, there is shown a side view of the completed bed assembly and showing the location of the block 30 and the straight member 26. It is important to note that in the Figure, the entire universal cross member 18 is spaced above the floor, shown at 32 and therefore no part of the universal cross member 18 is actually supported by the floor 32. Thus, as previously stated, the present invention is aptly usable where the length of the legs of a headboard and footboard are unknown since the universal cross member 18 of the present invention does not require a support or attachment that relies on the plane of the floor.

Figure 2A:
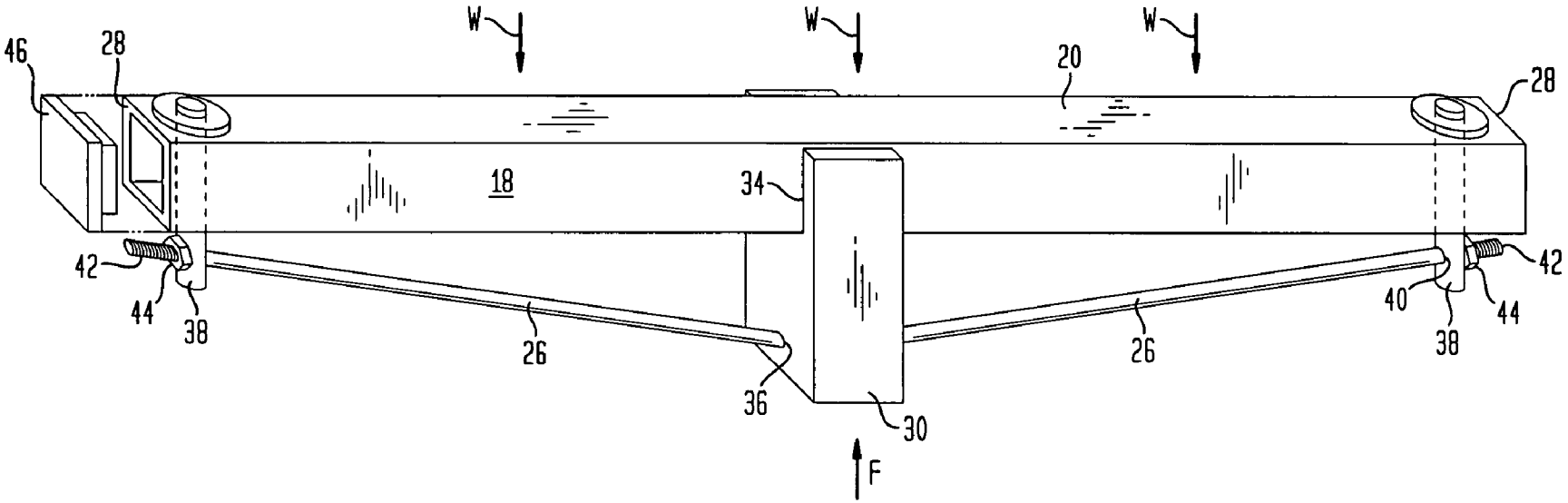
FIG. 2A is an enlarged perspective view of the universal cross member of the present invention.

Turning now to FIG. 2A, there is shown an enlarged perspective view of a universal cross member 18 constructed in accordance with the present invention, In this Figure, the straight member 20 is shown with a generally square cross section, however other configurations and cross sections may, of course be utilized as previously explained. As can also be seen, the block, 30 is positioned at approximately the mid point of the straight member 20 amid its ends 28 and, in this embodiment, the block 30 has a generally square shaped recess 34 and the straight member 20 fits with the recess 34 so that the block 30 is held in its proper position. The tension bar 26 passes through a suitably shaped opening 36 in the block 30 and is secured at its ends to a pair of fittings 38 that pass through and are thus secured to the straight member 26 at approximately the ends 28 of straight member 26.

The fittings 38 have openings 40 through which the threaded ends 42 of the tension bar 26 pass and nuts 44 are threadedly engaged to the threaded ends 42, the purpose of which will be explained, Finally, a cap 46 can be used to seal the ends of the straight member 20 (only one of which is shown) and which has an aesthetic appearance and protects against injuries from inadvertently hitting the relatively sharp ends 28 of straight member 20.

The actual manufacture and use of the universal cross member 18, in this embodiment, can now be described. In assembly, the block 30 having the tension bar 26 passing therethrough is assembled so that the straight member 20 is fitted to recess 34. The nuts 44 are then tightened on the threaded ends 42 of the tension bar 26 creating an upward force that is communicated through the block 30 to the approximate center of the straight member 20 while at the same time pulling the ends inwardly and downwardly. Obviously, the more the nuts 44 are tightened, the more of a force is applied to that center of the straight member 20. In the normal use of the invention, the nuts 44 are tightened such that the straight member 20 begins to become slightly convex, that is, the center will bow upwardly slightly in the direction that the force is applied by the block 30.

In this manner, the upward force, indicated by the arrow F, creates a slight bowing or bending to the straight member 20 and which provides additional strength to act in supporting and countering the weight acting downwardly on the straight member 20 in the direction of the arrows W. That weight is, of course, imposed by the load applied by the weight of the box spring, the mattress and any occupant of the bed assembly. Accordingly, the use of the tension bar 26 to pre-stress the straight member 20 by applying a force in the upward direction, against the force imposed by the weight borne by the straight member 20 is such that the need for a glide or other support that actually contacts the floor is unnecessary in almost all applications.

In the event the load imposed by the weight of the mattress is a considerable load, such as might be imposed by the use of a water bed, it is possible to add an additional support in the form of a glide or caster that actually contacts the floor as a supplemental support to the universal cross member 18, however the need is very infrequent and as such, the universal cross member 18 can be used in almost all applications where the height of the side rails from the floor is unknown without any actual contact with the floor.

In carrying out the present invention, therefore, the preferred embodiment has disclosed a single tension bar 26 that passes through the block, however, it will be obvious that the tension 26 may be two individual bars that are secured to the block 30 or may be any other tensioning arrangement that would force the block 30 in the upwardly direction generally at the center of the straight member 20 to tend to bow that straight member 20 in the direction opposing the weight of the box spring and mattress. As also shown, the block 30 may be an injection molded plastic construction, a cast metal unit, wood, a metal stamping or other solid material, the essence being that it is of some finite dimension so that the stretching and tensioning of the tension bar 26 will create a force on the straight member 20 countering the force exerted by the weight of the box spring, mattress and the like that is supported by the straight member 20.

In addition, the preferred location of the fittings 38 are at or near the ends 28 of the straight member 20 to allow the efficient and optimum tensioning of the straight member 20 by pulling the ends 28 inwardly and downwardly while exerting a force upwardly at the approximate center, however, the actual tension and bowing effect applied to the tension bar 26 could be accomplished by affixing the ends of the tension bar 26 at some intermediate point between the center of the straight member 20 and the ends 28 of the straight member 20.

Figure 2B:
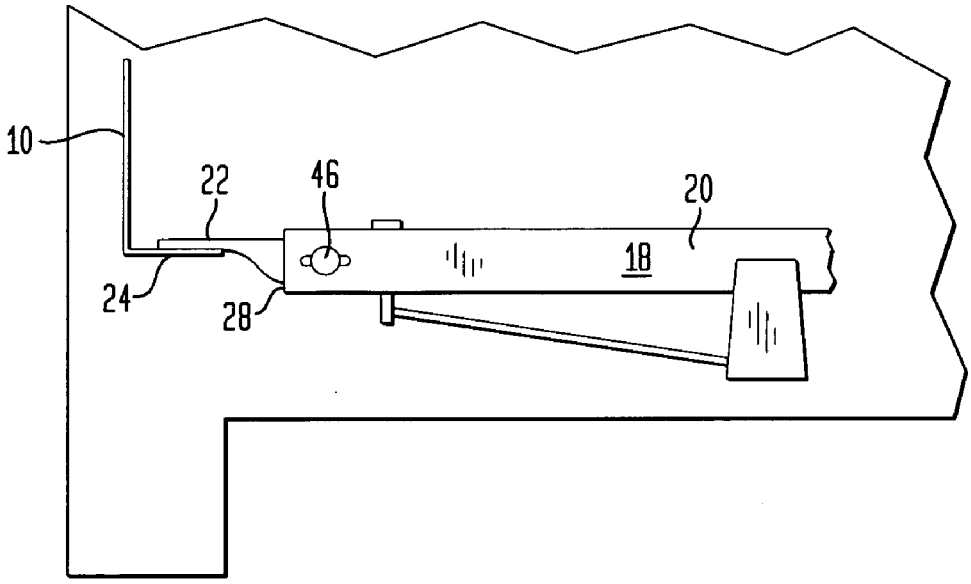
FIG. 2B is side schematic view showing the universal cross member of the previous Figures in position affixed to a side rail.

Turning now to FIG. 2B, there is show a schematic view of a portion of the universal cross member 18 showing its connection to the side rail 10. As is seen, the end bracket 22 rests on the horizontal surface 24 extending from the side rail 10, The end bracket 22 is configured to the same general cross section as the interior of the straight member 20 and fits slidingly within the internal area of the straight member 20 such that the end bracket 22 can be telescoped therein. Thus there is a certain movement of the end bracket 22 outwardly and inwardly with respect to the end 28 of the straight member 20, thereby allowing the overall length of the universal cross member 18 to be adjustable in accordance with the span or distance between the side rails 10. When the specific desired length of the universal cross member 18 has been established, a device is provided to secure the end bracket 22 at that particular length. The device may be a bolt 47 that passes through the straight member 20 and passes through an elongated opening in the end bracket 22 so that the end bracket 22 can be secured in the desired length by tightening the bolt 46 as will later be further described.

Figure 3A:
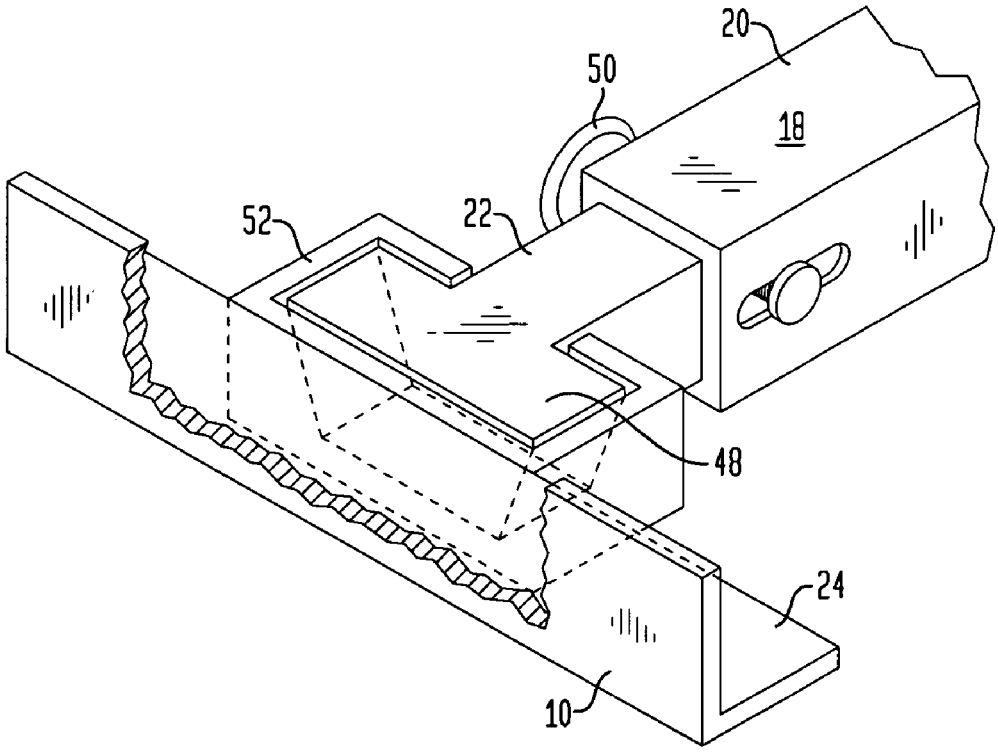
FIG. 3A is a enlarged perspective view, partially cut away, illustrating one means of connecting the universal cross member of the present invention to a side rail.

In FIG. 3A, there is shown an enlarged perspective view, partly in section, showing one possible means of attaching the universal cross member 18 to the side rail 10 and utilizes a male bracket 48 that is formed in the outer end of the sliding end bracket 22 that is, in turn received with in the interior of the straight member 20. Again, the bolt 46 can be used to secure the end bracket 48 at the particular length desired for the universal cross member 18 and a knob 50 is tightened on the threaded end of the bolt 46 to tighten the end bracket 22 in the selected position. In this embodiment, a female bracket 52 is affixed to the side rail 10, resting on the horizontal surface 24 or by other means and both the male end bracket 48 and the female bracket 52 are tapered inwardly so that the male end bracket 48 can simply be fitted into the female bracket 52 to form a connection between the universal cross member 18 and the side rail 10. A similar connection may be made at the other end of the universal cross member 18 so that the universal cross member 18 can simply be inserted into its position spanning between the side rails 10 to complete the assembly of the bed frame.

Thus, with the previously described feature where the universal cross member 18 does not require a support intermediate its ends contacting the floor, it can be seen that the universal cross member 18 can be used with a wide variety of headboards having differing length legs and also with a wide variety of side rails having differing lengths spanning between the side rails and the universal cross member 18 is usable with any of such combinations of components.

Figure 3B:
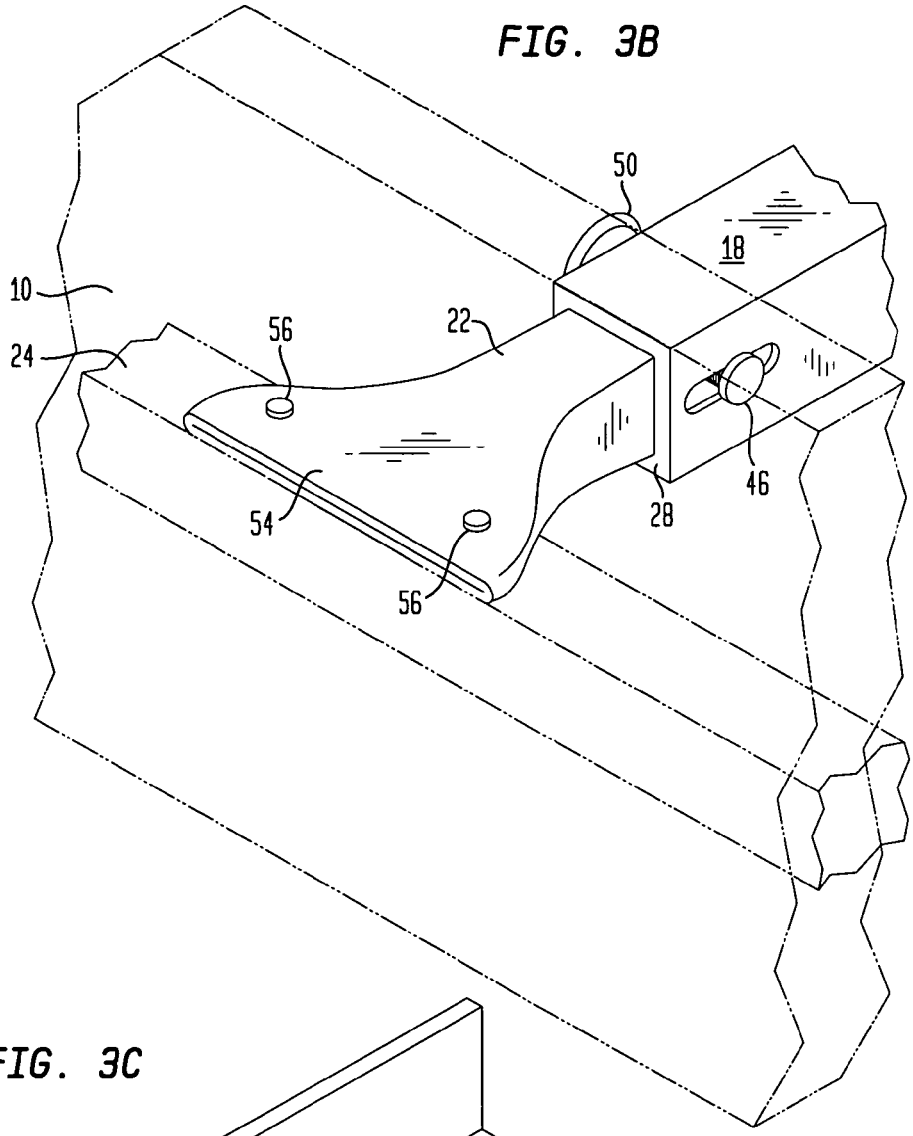
FIG. 3B is a further perspective view, partially cut away, of an alternate means of affixing the universal cross member to a side rail.

Turning now to FIG. 3B, there is shown an enlarged perspective view of a side rail 10, partially cut away, illustrating another means of interconnecting the universal cross member 18 to that side rail 10. In this embodiment, the side rail 10 is shown as a typical wood side rail having a lip with a horizontal surface 24 for positioning and attaching the universal cross member 18. In this embodiment, the outer end of the end bracket 22 is flattened and flared so as to create a generally wide, flat end 54 of the end bracket 22 and which can be rested on the horizontal surface 24 and be secured thereto by means such as wood screws 56 that are directly screwed into the side rail 10. Again, the end bracket 22 is telescoped within the end 8 of the straight member 20 so that the end bracket 22 can be extended and retracted from that end 28 to account for the particular width or span between the side rails 10 in constructing the bed frame.

Figure 3C:
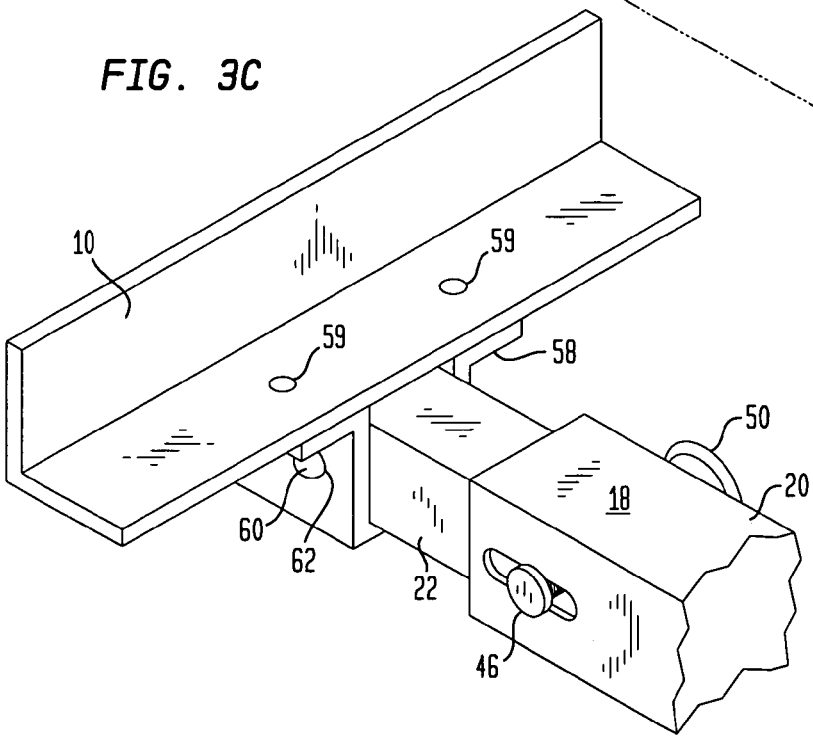
FIG. 3C is a still further perspective view of another embodiment of the universal cross member illustrating a further means of connection to a side rail.

In the still further embodiment as illustrated in FIG. 3C, there is shown an enlarged perspective view of a side rail 10 having a lower bracket 58 that may be affixed to the lower side of the horizontal surface 24 by means such as rivets 59. The lower bracket 58 is thus configured to be the same or a suitable similar shape to receive the end bracket 22 and, as shown, that shape is generally a square shape. Thus, again, the end bracket 22 can be adjusted to the desired length by its sliding fit with the straight member 20 and fitted into the similarly shaped lower bracket 58. To fully secure the end bracket in such position, a spring loaded button 60 can be employed that pops through an opening 62 in one of the sides of the lower bracket 58.

Figure 4:
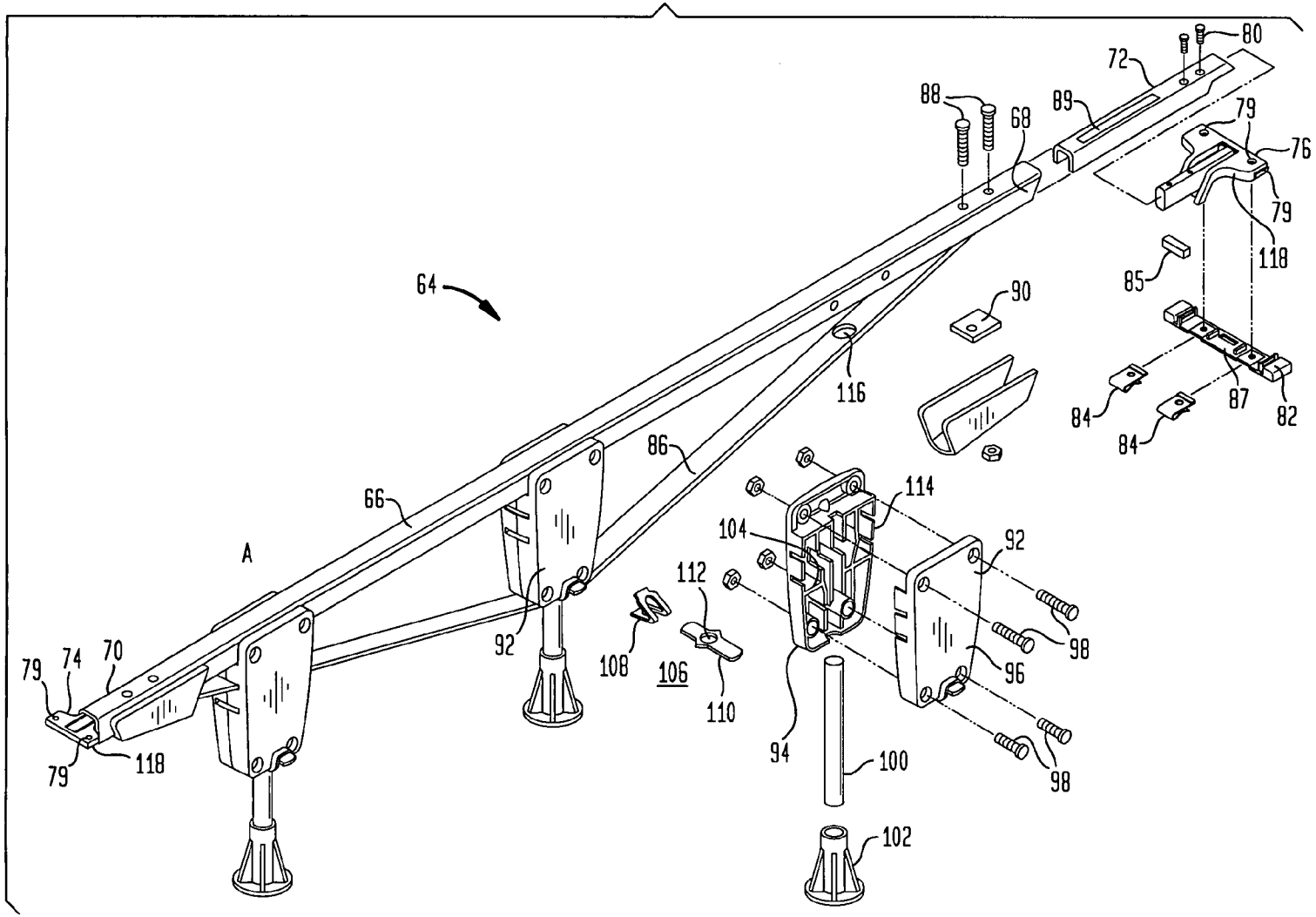
FIG. 4 is a perspective view, partially exploded, of an embodiment of the universal cross member as constructed in accordance with the present invention.

Next, there is shown in FIG. 4, a perspective view, partially exploded, of the universal cross member 64 constructed in accordance with the preferred embodiment. In this embodiment, the straight member is 66 is a cold rolled steel welded tube, preferably of a square cross section configuration. The straight member 66 has free ends 68, 70 that are open and into which slides 72, 74 are fitted that are slidingly engaged within the straight member 66. The slides 72, 74 are also preferably formed of a metal. As can be seen with reference to the prior embodiments, the slides 72, 74 allow the overall length of the universal cross member 64 to be adjusted by the user easily to fit between the side rails of differing bed frames. At the free or outer ends of the slides 72, 74, there are slide ends 76,78 that can be comprised of a cast metal, but preferably a molded plastic material of glass filed nylon and are molded to the particular desired configuration. The slide ends 76,78 can be affixed to the slides 72,74 by means such as screws 80.

The slide ends 76, 78 can be configured to any particular configuration to enable those components to be readily affixed to the side rails of the bed frame. There are screw holes 79 to enable the user to screw the slide ends 76, 78 to a wooden bed rail, however, the same molded slide ends 76, 78 can also be connected to the side rails by means of a quick snap connection. In the embodiment shown, there are rail connectors 82 (only one of which is shown) that enable the easy connection of the slide ends 76, 78 to that side rail. As seen, the rail connector 82 may be affixed to a side rail that is a conventional L-shaped angle iron by a air of steel U-clips 84 or, alternatively, where the side rail is a wooden member, the wooden side rail may be worked to provide a suitable shaped recess into which the rail connector 82 an rest.

Once in place, the rail connector 82 can be used to easily affix the slide ends 76, 78 to the side rails of the bed frame or bed rails without the use of special tools and thus can readily be assembled to set up the bed unit. As a further feature of the rail connector 82, there may be a plug 85 that is removable from the rail connector 82 and which is generally rectangular and, when used, fits downwardly into the opening 87 in the rail connector 82.

As such, in the event the user desires to use the rail and slat connection shown and described in U.S. Pat. No. 4,745,644 of Pottschmidt, the rail connector 82 can still be used with that system by utilizing the plug 85 so that the opening 87 aligns with the normal opening in the side rail system of the '644 patent. The actual slide ends 76, 78 as well as the use of the plug 85 will be latter explained, however, it is sufficient to note that the use of the plug 85 enables the present invention to be used with a rolled side rail as disclosed in the aforementioned Pottschmidt patent.

In this embodiment, the tension member 86 comprises a cold rolled steel strap that is affixed to the straight member 66 at or near the free ends 68,70 thereof by means such as rivets 88 that pass through the straight member 66, the free ends of the tension member 86 and may also have a guide plate 90 to aid in that affixation. As shown in FIG. 4, there are elongated slots 89 formed in the slides 74 to allow the rivets 88 to pass through the slides 74 without impeding the lateral or extending movement of those slides 72,74.

In the assembly and the affixing of the tension member 86 to the straight member 66, t is preferred that there be a pre-tension effect, that is, as with the prior embodiments, the tension member 86 is preferred to be in tension as the universal cross member 64 is assembled. To the end, the force transmitting means 92 is a molded plastic housing that is comprised of two housing components 94, 96 that are joined together by means such as rivets 98. The force transmitting means 92 is also preferably affixed to the straight member 66 by means of the rivets 98. As can be seen, the tension member 86 or steel strap passes underneath the force transmitting means 92 so as to displace the tension member 86 from the straight member 66. There may be a variety of means to retain the tension member 86 in position beneath the force transmitting means 92 including nubs formed on the bottom of the housing components 94, 96 during the molding process that may interfit into suitably positioned and shaped apertures formed in the tension member 86.

In any event, during the manufacturing and assembly of the universal cross member 64, a pre-tension is created in the tension member 86 by creating a slight bow in the straight member 66 with the center of the straight member 66 bowed slightly upwardly with respect to its free ends 68, 70 and retained in the slightly bowed configuration while the ends of the tension member 86 are riveted to the straight member by the rivets 88. Thus, upon release of the straight member from the forced bowed position, the straight member 66 will attempt to straighten out and will create a tension in the tension member 86. It is possible, and normal, that the straight member 66 will maintain a slight bow at the termination of the assembly process and the affixing of the tension member 86 to the straight member 66.

In an ideal manufacturing and assembly process, it is possible that there be no actual bow in the straight member 66 after completion of the affixing of the tension member 86 and that the actual tension in the tension member 86 be such that the tension would immediately be created upon a weight being placed on the straight member 66, such as the weight of a box spring when placed onto the bed frame. In such case, the tension member 86 is affixed so as to be taut but without actual tension created in the tension member 86.

However, the manufacturing tolerances are quite difficult to achieve and maintain long with the required precision of assembly and thus rather the place very strict tolerances on the assembly and the manufacturing of the components, the slight bow is preferred within the tension member 86 with a positive tension and slight bow upon its being affixed to the straight member 66.

As can also be seen in FIG. 4, there are instances where the universal cross member 64 requires some support of the floor to provide sufficient strength to support the bed components. As indicated, the support of the floor may be needed if an excessive load is being carried by the bed frame, such as when a water bed is being utilized. In such instance there is a need for a leg to span the distance from the straight member 66 and the floor to provide that support. In the preferred embodiment of FIG. 4, the leg 100 can conveniently be retained to the straight member 66 by means of the force transmitting means 92 by affixing the leg 10 to the housing components 94,96. The leg 100 will generally also include a glide 102 affixed to the bottom thereof to contact the floor in a sturdy relationship.

In the molding of the housing components 94,96, there is a central space 104 that is formed in the interior of both of the housing components 94, 96 of a mirror image and which allows the leg 100 to fit within the central space 104. The length of the central space 104 is predetermined to allow the leg to be withdrawn into the force transmitting means 92 and to be extended outwardly and downwardly therefrom to adjust the length the leg 100 protrudes downwardly from the force transmitting means 92 to contact the floor. Thus, when the housing components 94, 96 are assembled together, the leg 100 is inter-fitted into the central space 104 intermediate the housing components 94, 96.

A leg release mechanism 106 is also provided and is affixed intermediate the housing components 94, 96 and which serves to allow the leg 100 to be extended from the housing components 94,94 to the desired extension and locked into that extended position. The leg release mechanism comprises a catch spring 108 and a catch 110. As assembled, the catch 110 has a hole 112 that is sized so as to allow the leg 100 to be snugly, sliding fitted within the hole 112. The catch spring 108 acts upon the catch 110 to maintain the catch 110 in a tilted position with respect to the leg, 100 that extends vertically downwardly.

Accordingly, when the catch 110 is tilted with respect to the horizontal, the hole 112 is tilted with respect to the leg 100 and captures or retains the leg 100 sturdily affixed to the catch 110, and, obviously, also to the force transmitting means 92. The catch 110 can easily be pressed by the user against the bias of the catch spring 108 to move the catch 110 to a horizontal position to free the leg 100 from its retained, locked position. Thus, by a simple manipulation of the catch. 110, the leg 100 can be released for movement with respect to the force transmitting means and again released to retain the leg firmly in the desired position. As shown, there is only one catch 110, however, in order to provide addition locking strength, there may be a plurality of stacked catches 110 nested together and all operable by the same catch spring 208. As such, with a plurality of catches, possible two or three catches 110, the locking of the leg 100 is made more positive with additional strength.

As can therefore now be seen, when the universal cross member 64 is installed on a bed frame or bed rails in the desired location in a room in supporting, for example, a water bed, the user merely has to press on the catch 110 and the leg 100 will become free to move. The leg 100 will thus move downwardly by gravity until it encounters the floor where it stops. The user can then release the catch 110 and the leg 100 will be firmly secured in the position touching the floor to act as a support for the straight member 66. The leg 100 can just as easily be retracted into the housing components 94, 96 to retract the leg upwardly into the housing components 94, 96 when the user desires to move the bed within the room or to another room to avoid the leg glide 102 from being damaged by catching on the carpet or other hindrance to the movement. Obviously, to retract the leg 100, the catch 110 must be depressed and the leg physically pushed upwardly by the user into the housing components 94, 96 and when the catch 110 is allowed to return to its original biased position, the leg 100 will remain in the retracted position.

By the use of legs having differing lengths, the adjustability of the universal cross member 64 can be utilized with almost any height of a bed from the floor. For example, in the preferred embodiment, the central space 104 may allow an adjustment in the extension of the leg 100 of about 4.5 inches. By the use of different lengths of legs, the amount of adjustment available to the user for different heights of a bed above the floor can be extended .e. the installer or user can be provided with two legs of a 5.5 inch length and 9 inches in length where either leg can interfit with universal cross member 64. Thus, by choosing the appropriate length leg, the overall vertical height above the floor of the universal cross member 64 can span 6.5 to 14 inches. Obviously, with other length legs, the overall adjustment allows the universal cross member 64 to have considerable versatility to be used with beds having a wider range of vertical heights from a floor.

By the construction of the housing components 94, 96, the leg 100 may also be located at other positions along the straight member 66, as, for example, the leg position illustrated in FIG. 4 at A. In this location, the housing components 94, 96 of the tension member 86 are molded to have lateral slots 114 formed in those housing components. As shown, there are two sets of slots 114 so that the leg 100 can be affixed to the housing components 94,96 at various positions as desired depending upon the particular load borne by the bed frame and the tension member 86 can pass through the interior of the housing components 94, 96 in the desired position. In any such location, there are openings 116 formed in the tension member 86, one of which is shown in the Fig, so that the leg 100 can pass through the tension member 86 at the particular location.

As noted, again, the position of the leg 100 along the straight member 66 also is made easier by the use of the adjustable leg feature previously described to enable the user to adjust the leg 100 to the proper length to contact the floor in any position along the straight member 66. The use of the additional side legs as shown in FIG., 4 are used when a water bed is being supported by the bed frame and the additional legs in the locations A serve to not only support the universal cross member 64 but also to support the side rails that are considerably overburdened by the additional weight imposed by the use of a water bed. In any event, the legs are all vertically adjustable to the particular floor easily and without tools and eliminate the need to screw each leg down and balance the legs to assembly the overall bed.

Figure 4A:
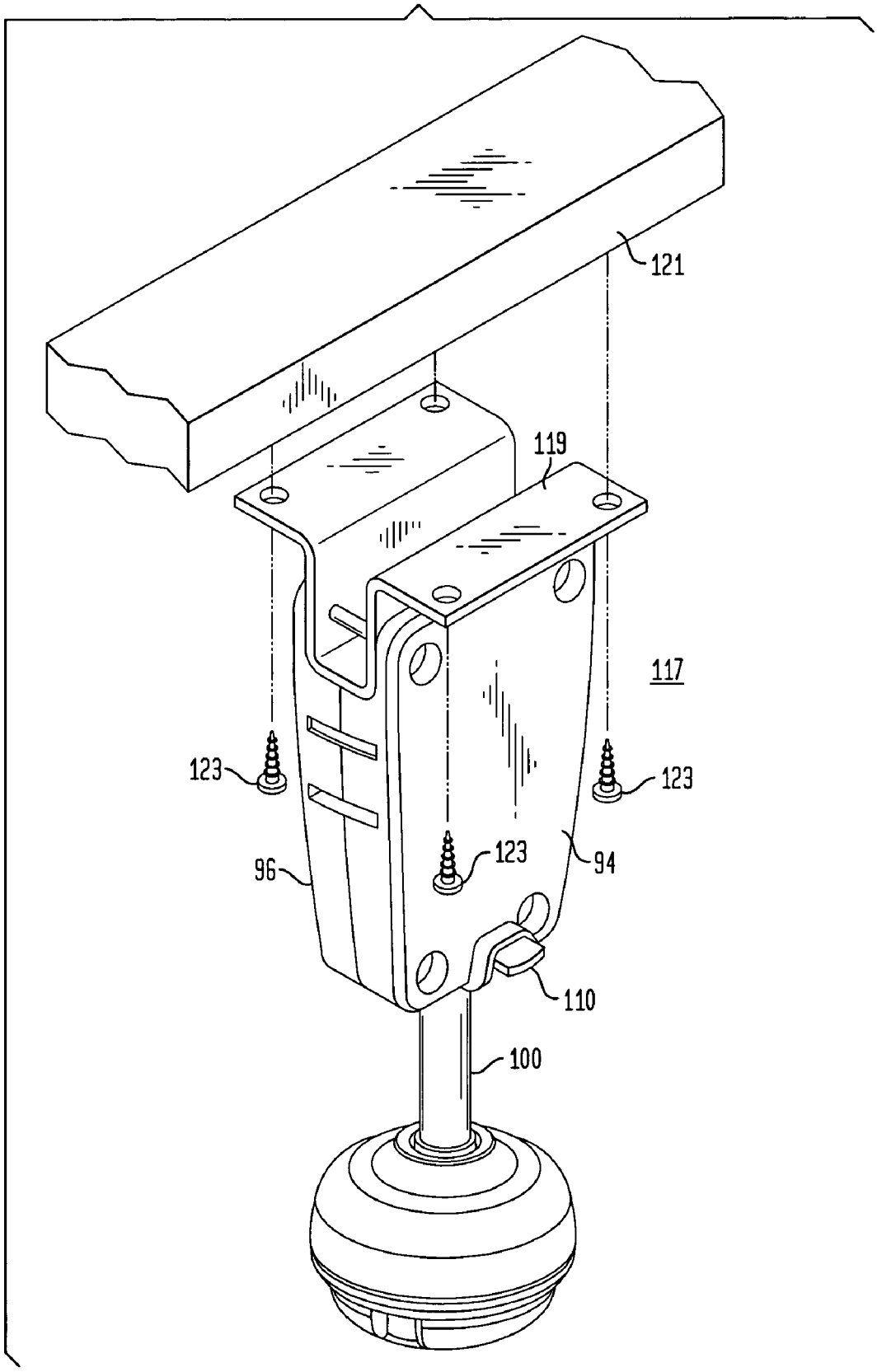
FIG. 4A is a perspective view of a leg assembly constructed in accordance with the present invention.

Turning now to FIG. 4A, there is shown a perspective view of a leg assembly 117 that can be used and which comprises the housing components 94, 94 of the prior embodiment. In this embodiment, however, the leg assembly 117 is adapted to be used as a support for any cross member or even a side rail or other piece of furniture. As can be seen, the housing components 94, 96 are the same components as used with the FIG. 4 embodiment and thus the leg 100 extends downwardly toward the floor to contact the floor and provide the needed support. The lower extremity of the leg 100 may be a glide, standard caster roller, or may be a specially designed caster assembly that is shown and described in U.S. patent application Ser. No. 09/519,725, now U.S. Pat. No. 6,568,031, issued May 27, 2003 and entitled "CASTER ASSEMBLY FOR A BED FRAME MEMBER OR FURNITURE, filed on the same day as the parent application of the present application and the disclosure of which is incorporated herein by reference.

In FIG. 4A, however, there is also an upper bracket 119 that is affixed to the housing components 94, 96 and which is used to affix the leg assembly 117 to a cross member or other structure to be supported. As shown the upper bracket 119 is used specifically with a wooden slat 121 and therefore the upper bracket 119 can be secured to that wooden slat 121 by means of screws 123. As can readily be seen, the leg assembly 117 can just as easily be used as a support for other structural components, including steel angle iron members, roll formed rails, or the like, the only difference being the particular configuration of the upper bracket 119. Thus, with the use of the present leg assembly 117 the user has the advantage of the ease of adjusting the vertical height of the leg by use of the mechanism described with reference to FIG. 4. As such, the leg assembly can be used with any of the aforementioned structures and the leg simply released by the user depressing the catch 110 to allow the leg 100 to drop downwardly until it reaches a support surface, such as a floor, and then by releasing the catch 110, the leg is secured in that particular height to lend support to whatever structure is in need of that support.

Figures 5, 5A:
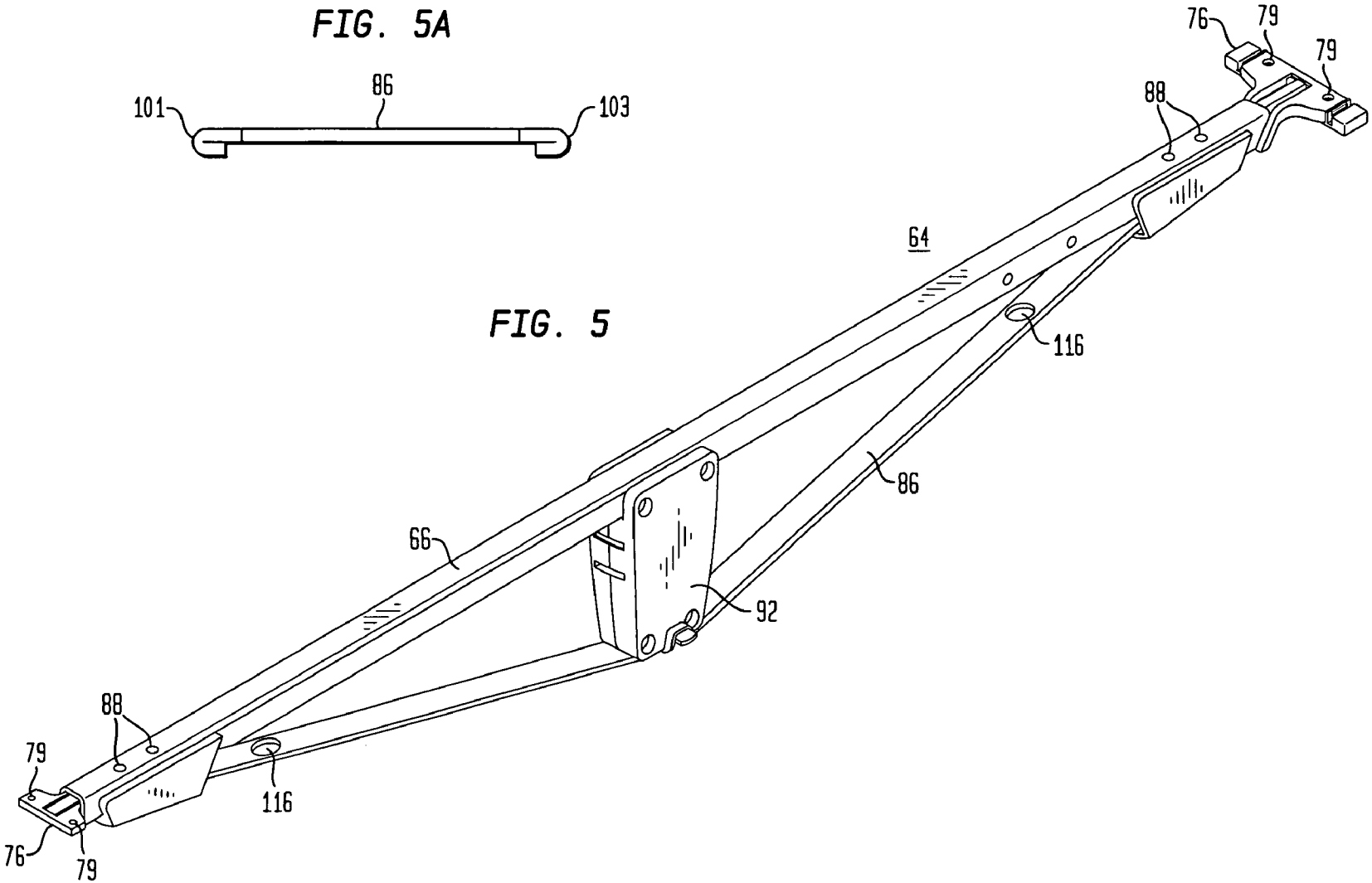
FIG. 5 is a perspective view of the preferred embodiment of the universal cross member constructed in accordance with the present invention.
FIG. 5A is an end view of the preferred tension member used in the present invention.

Turning now to FIG. 5, there is shown a universal cross member 70 as the preferred embodiment, that is, there are no legs used with the embodiment and thus no need to make any adjustment to any legs. Instead, the use of the tension member 86 alone is sufficient to provide the support to the straight member to support the particular box spring, mattress and the like. Thus, with the addition or lack of legs, the present universal cross member 64 can be used with a variety of bed sizes and loads. For example, with the use of a full bed, the universal cross member 64 may be used with one leg or can be used without any leg; with a queen size bed, the universal cross member 64 can have one leg or three legs and with a king size bed, there generally will be three legs used. In the instance of any of the multiple leg embodiments, the additional leg serves not only to add support to the cross member but additionally adds needed support to the side rails to support the additional load on those components.

Turning to FIG. 5A, there is shown an end view of the preferred tension member 86 and which is a steel strap wherein the ends 101 and 103 of the strap have been rolled inwardly so as to provide addition strength to the strap and additionally eliminate the otherwise sharp edges of the strap from posing a potential hazard to the installer or user.

Figure 6:
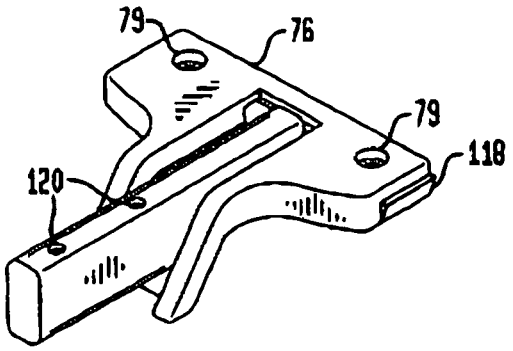
FIG. 6 is a top perspective view of a slide end component used with the present invention.

Next, turning to FIG. 6, there is shown a top perspective view of a slide end 76 constructed in accordance with the present invention. There are two screw holes 79 formed in the slide ends 76 and the outer edges of the slide end 76 are formed as upwardly shaped wedges 118 (only one of which is shown), the purpose of which will be later explained. Further openings 120 are also present to receive the screws 80 that affix the slide end 76 to the slide 72 (FIG. 4).

Figure 7A:
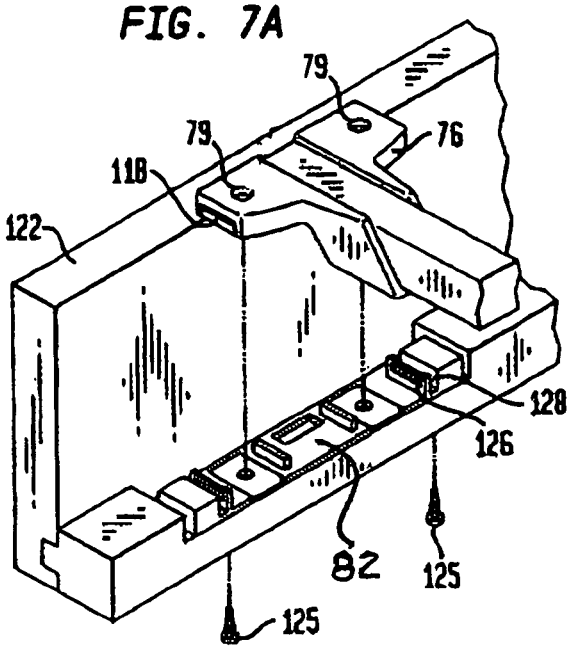
FIGS. 7 and 7A are schematic views of the slide end component of the present invention showing, respectively a slide end in position to be screwed to a wooden side rail and a slide end in position to be affixed to a wooden side rail through the use of a rail connector of the present invention.
Figure 7:
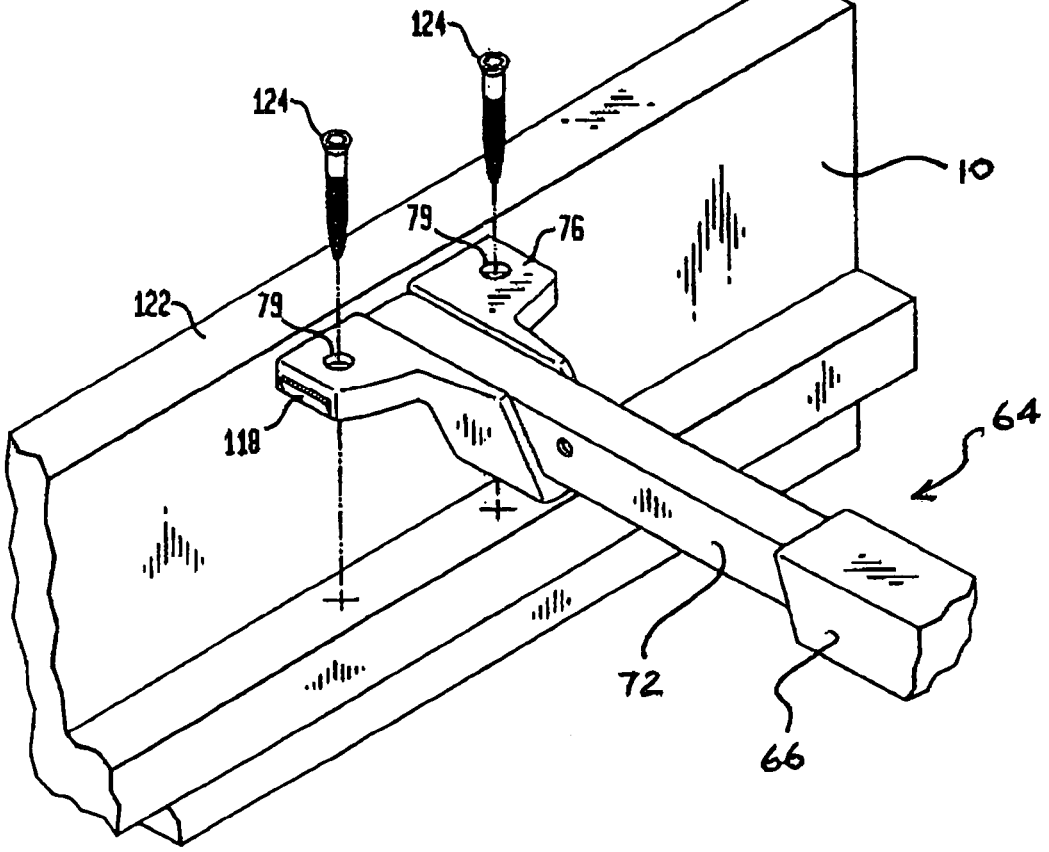

Turning now to FIG. 7, there is shown a schematic view of a slide end 76 in position to be affixed to a wooden side rail 122 and, as can be seen, wood screws 124 can conventionally be used to pass through the screw holes 79 to simply screw the slide end 76 to that wooden side rail 122. As will become apparent, therefore the slide end 76 is a versatile component and its ability to be directly fastened to the wooden side rail 122 by wood screws 124 is but one method of affixing the universal cross member 64 in its assembled position.

An alternate means of affixing the slide end 76 to the wooden side rail 122 is shown in FIG. 7A where a rail connector 82 is used to readily enable that connection. In this embodiment, the rail connector 82 is located in a gouged out portion of the wooden side rail 122, however, the rail connector 82 can also be simply mounted to the wooden side rail 122 by a surface mount and not require a working of the wooden side rail 122 to gouge out a site for the rail connector 82. However, in the Fig., the rail connector 82 is mounted within the gouged out portion by self tapping screws 125 that pass through the side rails 122 and into the rail connector 82 to retain the rail connector 82 to it position as shown.

A pair of flexible tabs 126 extend upwardly from the base of the rail connector 82 and each has a lip 128 extending inwardly located at the upper portion of the flexible tab 126. As will later be shown in more detail, there is an upwardly shaped wedge 118 formed on the lateral sides of the slide end 76 that interfits with the flexible tabs 126. Thus, as the slide end 76 is pushed downwardly into the rail connector 82, the flexible tabs 126 flex outwardly to enable the upwardly shaped wedges 118 to pass by the inwardly extending lips 128 and, when past that position, the flexible tabs 126 flex back to their original position so that the inwardly extending lips 128 capture the upward shaped wedges 118 to strongly retain the slide end 82 to the rail connector 82 tabs, and, therefore, retain the universal cross member 64 to the wooden side rail 122. As can thus be seen, the interconnection is easy, fast, and results in a solid connection that cannot easily become disconnected. In fact, with the present embodiment, the later detachment of the universal cross member 64 from the side rail 122 requires a tool, such as a screwdriver, to break the connection.

Figure 8:
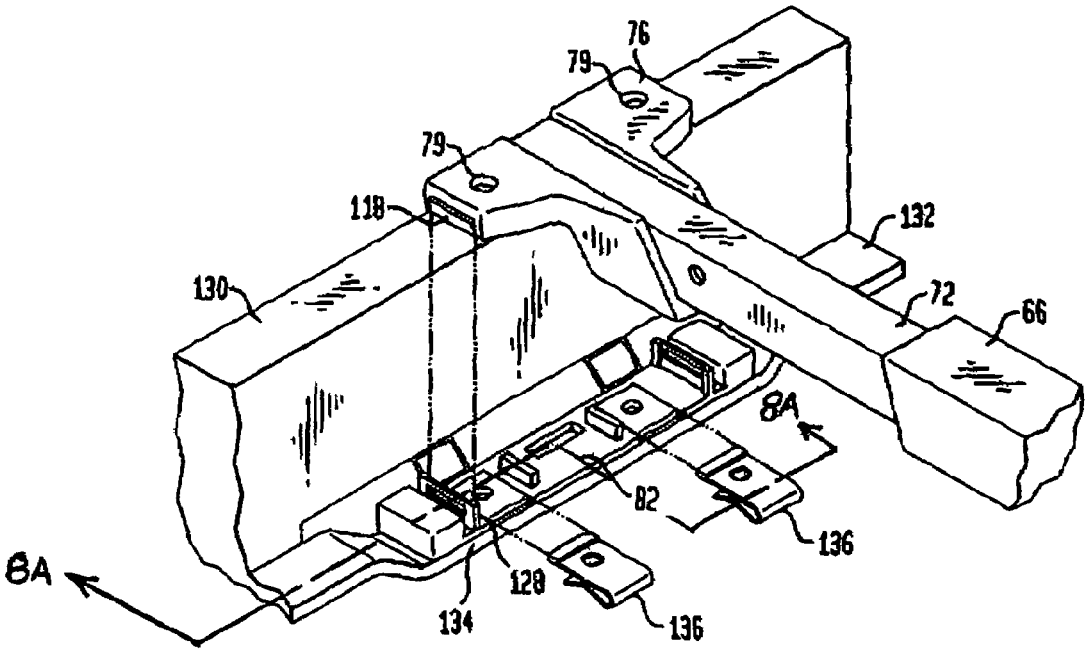
FIGS. 8 and 8A are schematic views, of, respectively, a slide end in position to be affixed to a custom roll form rail using a rail connector and a side view, partly in cross section, of a slide end affixed to a rail connector of the present invention.

Turning next to FIG. 8, there is shown a use of the slide end 76 to a custom roll formed rail 130 where the custom roll formed rail 130 has its horizontal flange 132 in which is formed a downward recess 134 for the locating of the rail connector 82. In this embodiment, the rail connector 82 is affixed to the horizontal flange 132 by means of metal clips 136 that have internal barbs formed on both inner side surfaces and which can be pushed into location to firmly affix the rail connector 82 to the custom roll formed rail 130. Again, the actual affixing of the slide end 76 to the custom formed rail 130 is as in the prior embodiment, that is, the slide end 76 is snapped into position and is held in that position by the inwardly extending lips 128 that capture the upwardly shaped wedges 118. Alternatively, instead of metal clips, the rail connector 82 can be affixed to the custom roll formed rail 130 by means of screws the pass through holes in the custom roll formed rail to be affixed in the same manner as illustrated in FIG. 7A.

Figure 8A:
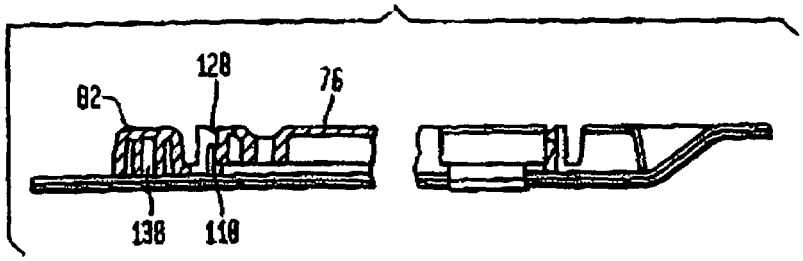

In FIG. 8A, there is shown a schematic side view, broken away and partly in cross section, of a completed connection between a slide end 76 and a rail connector 82 such that the inwardly extending lip 128 can be seen to hold the upwardly extending wedge 118 firmly in position to make the connection. As shown, the rail connector 82 is held to the custom roll formed rail 130 by the metal clips 136, however as also can be seen, there are blind screw bosses 138 formed in the rail connector 82 when the rail connector 82 is affixed to a side rail by means such as the screws of the prior embodiment.

Figure 9:
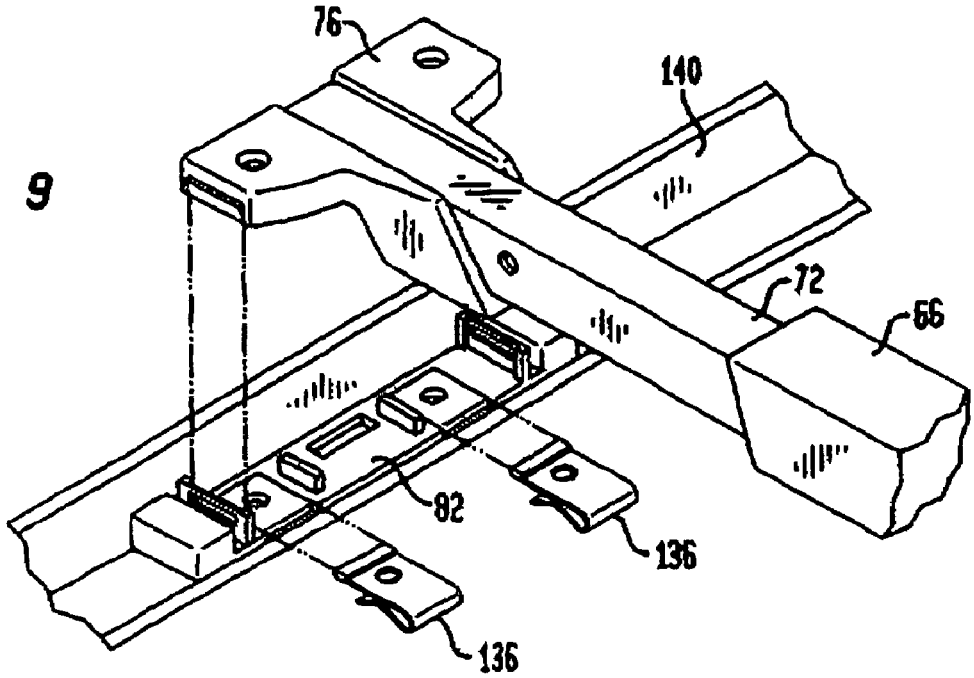
FIG. 9 is a schematic view of a slide end in position to be connected to a rail connector affixed to an angle iron side rail.

In the next FIG. 9, there is shown a schematic view of a slide end 76 in position to be connected to a rail connector 82 affixed to a standard angle iron side rail 140. Again, in this embodiment, the rail connector 82 is affixed to the angle iron side rail 140 by means of the metal clips 136 and the snap-in connection is also the same as discussed with reference to the prior embodiment.

Figure 10:
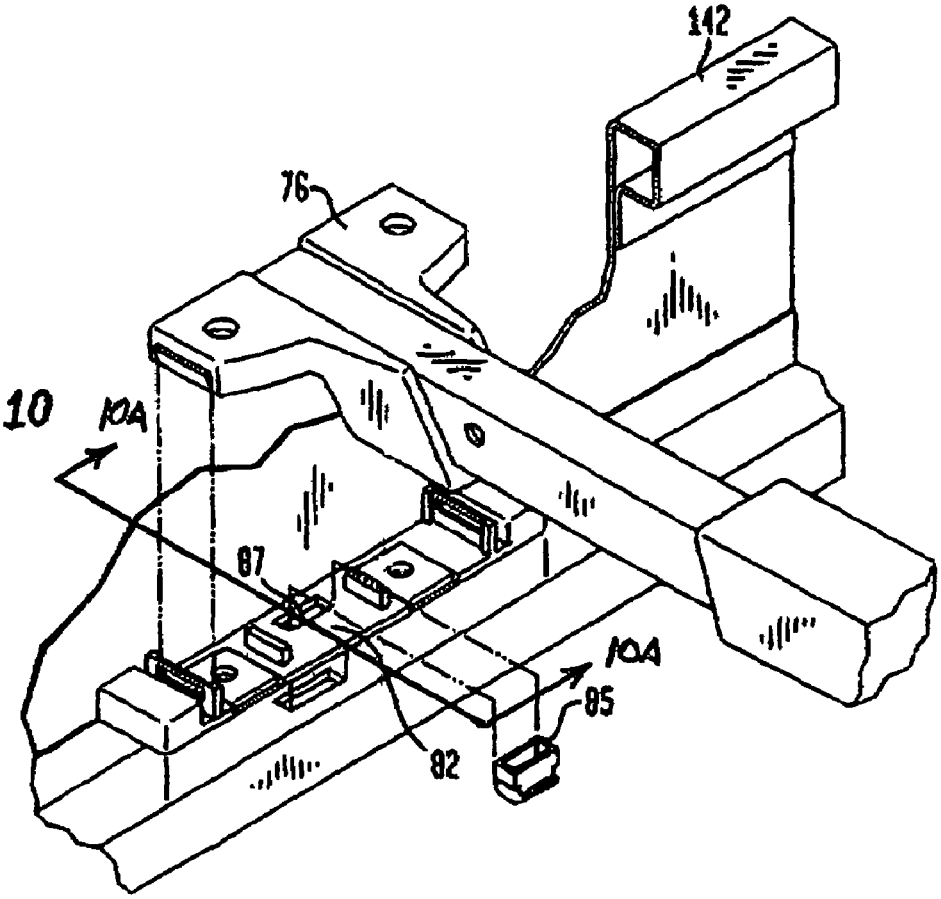
FIGS. 10 and 10A are, respectively, schematic views of a slide end in position to be connected to a roll form side rail using a rail connector and a side cross sectional view of a feature of the connected assembly of FIG. 10.
Figure 10A:
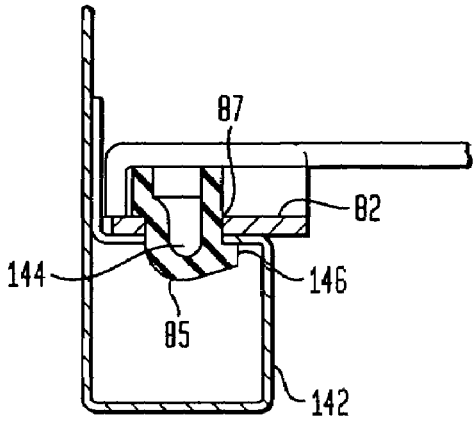

Turning now to FIGS. 10 and 10A, there is shown, respectively, a schematic view of a slide end 76 in position to be affixed to a existing roll formed rail 142 and a schematic side cross sectional view of the completed connection. Taking both FIGS. 10 and 10A, the slide end 76 is shown to be connected to a roll formed rail that is currently on the market and which is made in accordance with the disclosure of U.S. Pat. No. 4,745,644 of Pottschmidt. In that patent, the construction of the cross member or slat includes a downwardly facing tab 144 that fits into a corresponding generally rectangular opening in the roll formed rail 142.

Accordingly, with this embodiment the rail connector 82 can be installed so as to align the opening 87 in the rail connector 82 with the similar shaped opening already existing in the Pottschmidt roll formed rail 142. The plug 85 is then inserted into the opening 87 and passes through both the opening 87 in the rail connector 82 but also the existing opening in the roll formed rail 142. A barb 146 at the lower end of the downwardly facing tab 144 becomes positioned beneath the opening in the roll formed rail and by completing the assembly, that is, by snapping the slide end 76 into position into the rail connector 82 as previously described, tab 144 enters the plug 85 as specifically shown in FIG. 10A to hold the rail connector 82 to the roll formed rail 142 as the assemble is completed and the overall connection is accomplished easily and with any tools.

In FIGS. 10 and 10A the plug 85 is shown in position with the barb 146 facing inwardly toward the center of the bed and away from the exterior of the roll formed rail 142, however, the barb 146 can also be oppositely directed, that is, it can be faced outwardly toward the exterior of the roll formed rail 146, away from the center of the bed.

Figure 11:
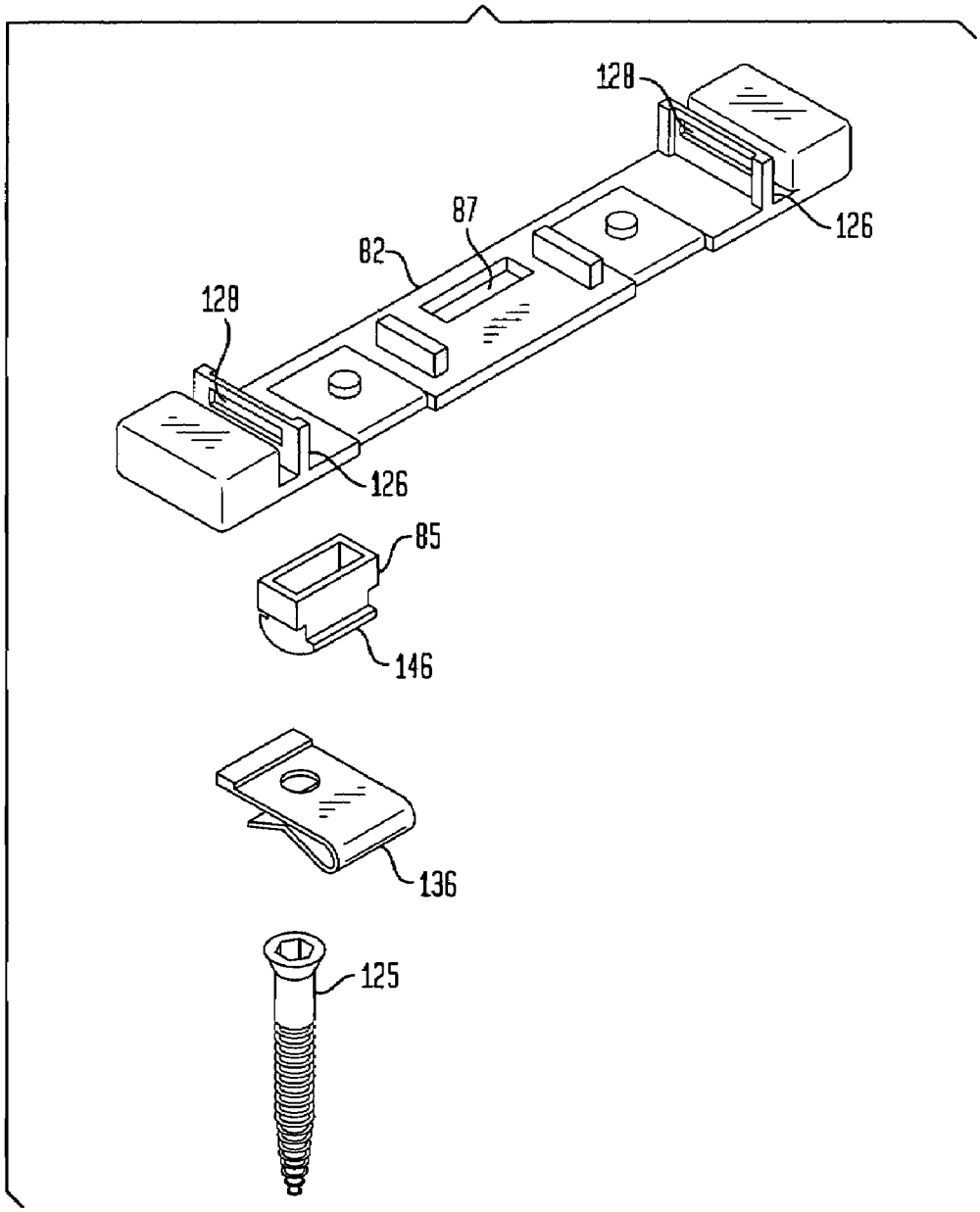
FIG. 11 is a perspective view of the components that make up a kit used to install the rail connector of the present invention.

In FIG. 11, therefore, the individual parts to enable the rapid and easy connecting of the slide end 76 to a side rail can be marketed as a kit as a method of doing business as all of the components are easily contained within a kit in a single package and can be provided to customers to be used in a commercial or home installations. Thus, those components include the rail connector 82, the plug 85, metal clips 136 and self tapping screws 125 to enable any user to install the interlocking system to an existing side bed rail to gain the advantages of the present invention.

Figure 12:
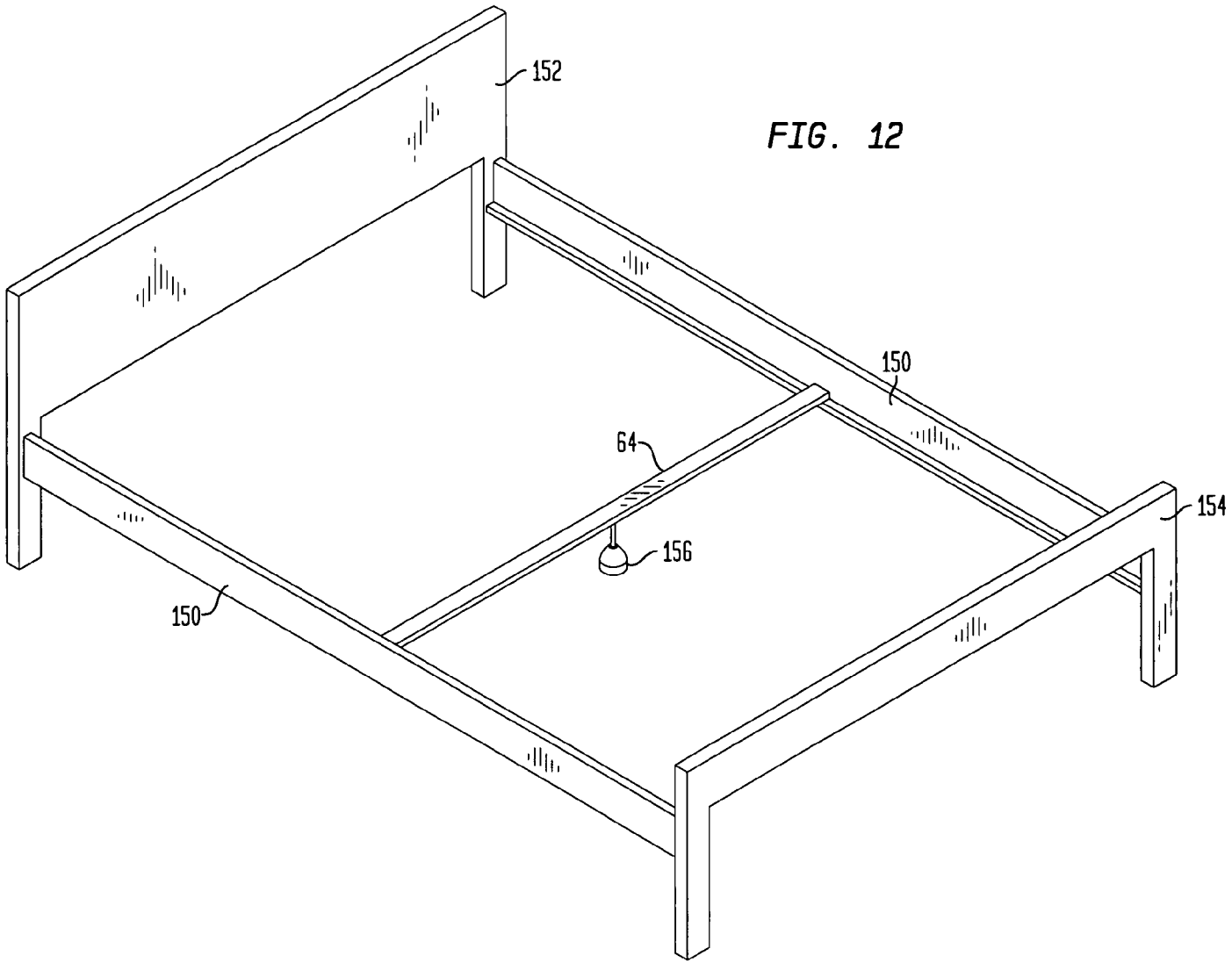
FIG. 12 is a perspective view of bed rails connecting between a headboard and a footboard including a cross member.

Turning now to FIG. 12, there is shown a perspective view of bed rails 150 connecting between a headboard 152 and a footboard 154 and showing a universal cross member 64 schematically. As can be seen, there is a caster assembly 156 that is affixed to the center of the universal cross member 64 that contacts the floor to support that member. Although the universal cross member 64 is shown in schematic, it is appreciated that it is similar to the embodiments shown and described herein with respect to FIG. 4 et seq.

Figure 13:
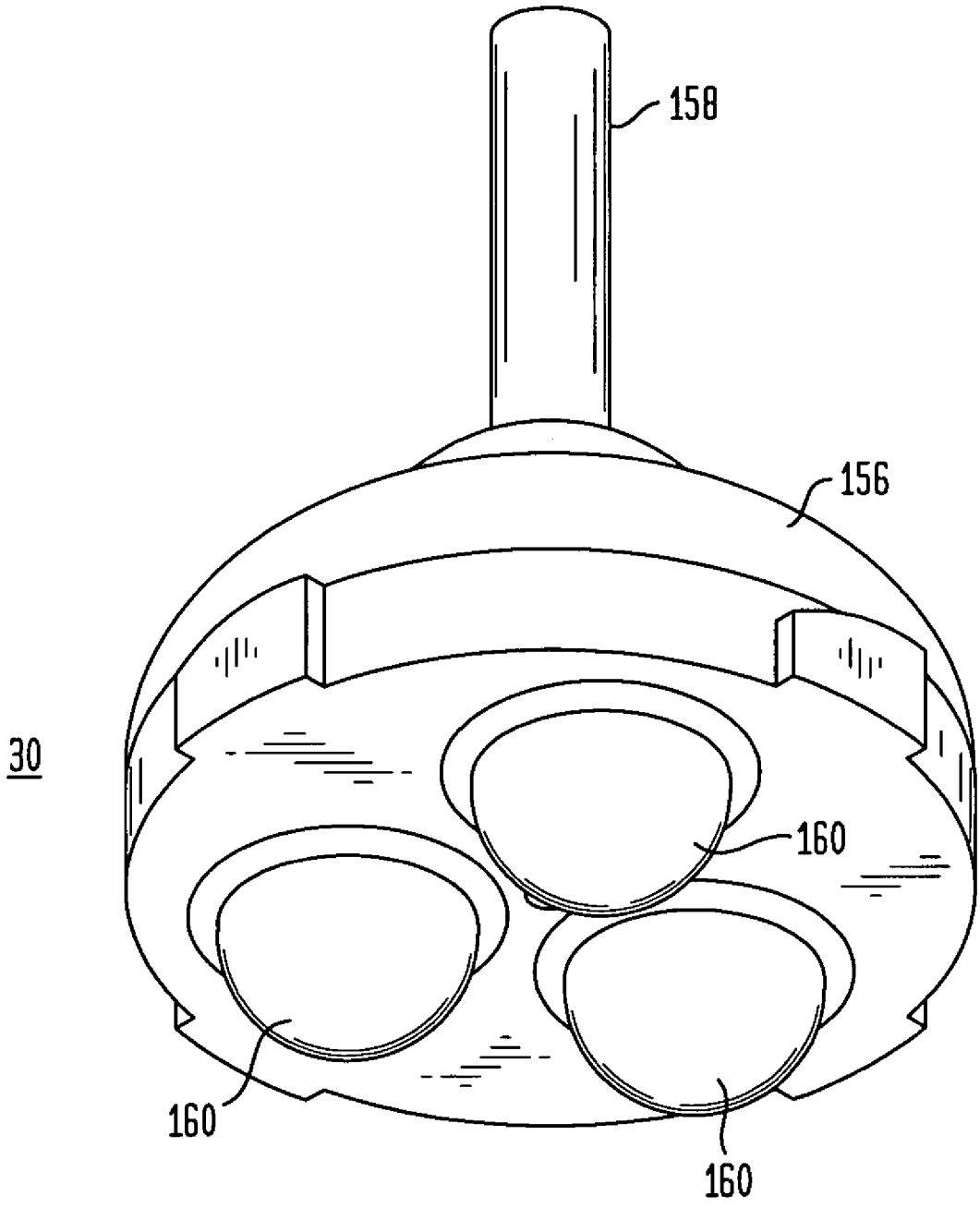
FIG. 13 is a perspective view of a caster assembly that can be used with the present invention.

Thus, finally, in FIG. 13, there is shown a perspective view of a caster assembly 156 that is affixed to the universal cross member 64 and which can be used in place of the leg used in the prior embodiments. In this caster assembly 156, leg extending downwardly from the cross member 66 so as to contact the floor and provide support to the overall completed bed. Thus, in this embodiment, the upstanding stem 158 can fit into the housing components 94, 96 of FIG. 4 and the caster assembly comprises a plurality of rollers 160 to provide support for the universal cross member 64. A caster assembly construction that is preferred for this embodiment is shown and described in U.S. patent application entitled CASTER ASSEMBLY FOR A BED FRAME MEMBER OR FURNITURE, U.S. Ser. No. 09/519,725, now U.S. Pat. No. 6,568,031, issued May 27, 2003, and filed on the same date as the parent application of the present application, the disclosure of which is incorporated in its entirety into the present application by reference thereto.

Figure 14:
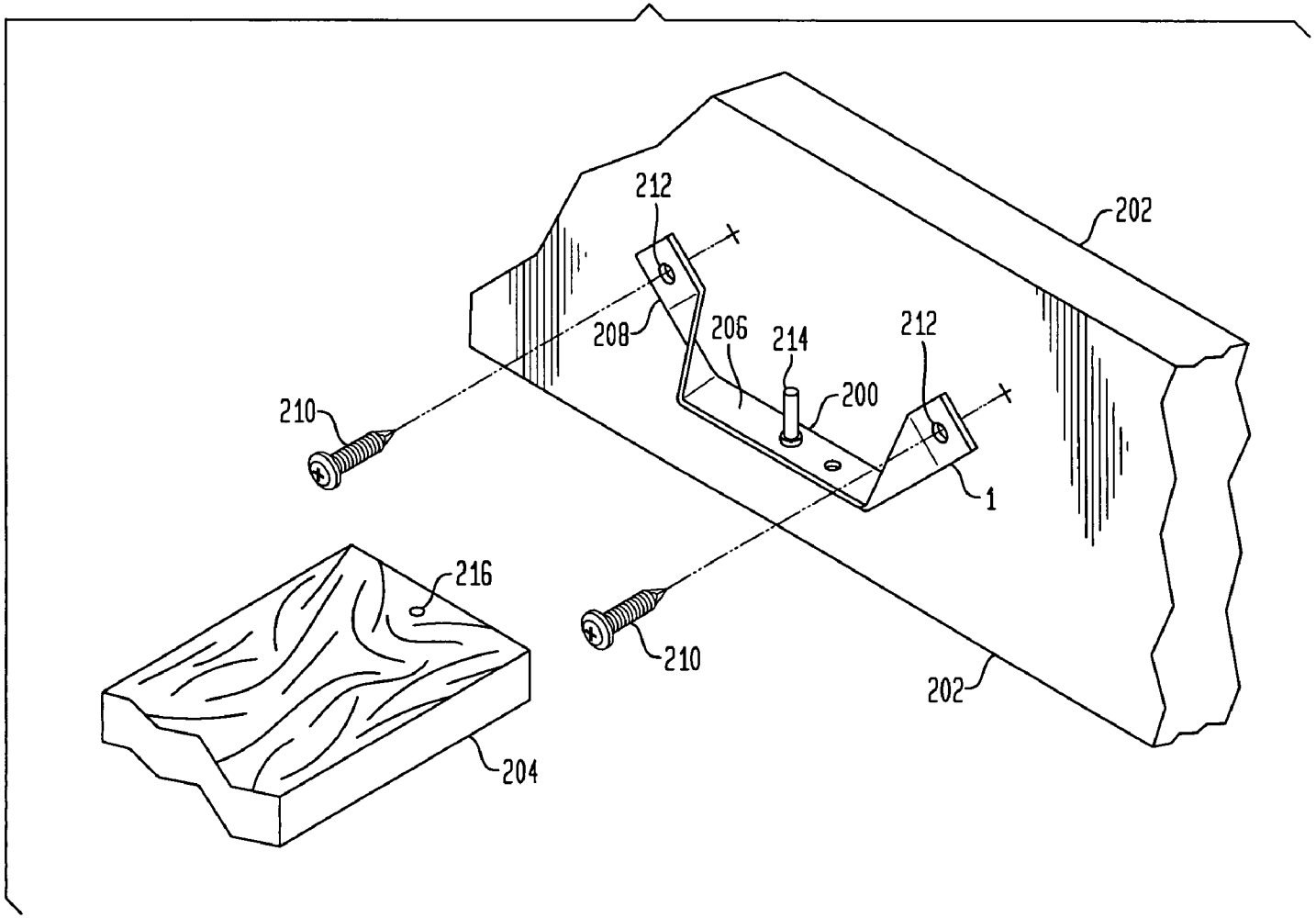
FIG. 14 is perspective view of a prior art support bracket for affixing a wooden bed slat to a wooden side rail.

Referring now to FIG. 14, there is shown a perspective view of a prior art support bracket 200 that is in position so as to be affixed to a wooden side rail 202 in constructing a bed frame utilizing a wooden slat 204. As can be seen, the support bracket 200 is basically a flat metal body 206 having its ends 208 twisted ninety degrees so as to lay flush with the internal surface of the wooden side rail 202. Thus, the support bracket 200 can readily be affixed to the wooden side rail 202 by means of wood screws 210 that pass through openings 212 in the ends 208 of the flat metal body 206.

The support bracket 200 also has an upstanding pin 214 that extends upwardly so as enter into and fit within a bore 216 formed in the wooden slat 204 so that, in assembling the bed frame, the wooden slat 204 is attached to the wooden side rail 202 by slipping the pin 214 into the bore 216 whereupon the wooden slat 204 slides down on the pin 214 to rest on the upper surface of the flat metal body 206.

Figure 15:
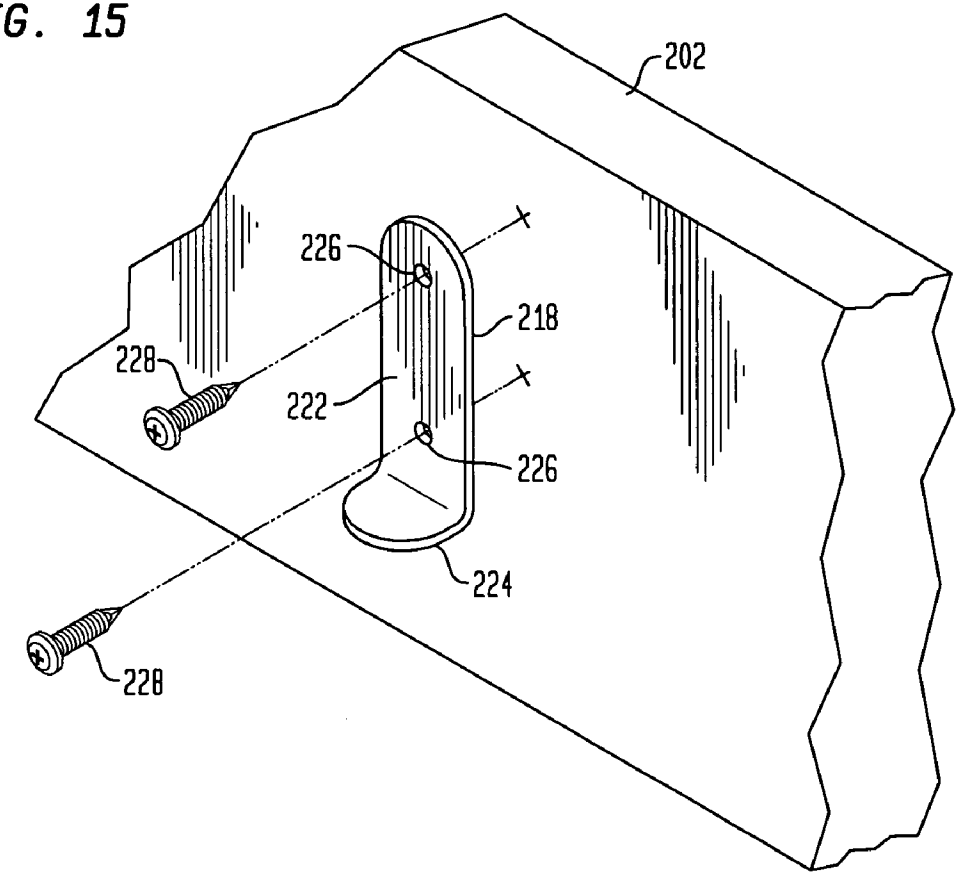
FIGS. 15 and 15A are, respectively a perspective view and a side view of a further prior art system for affixing a box spring within the wooden side rail of a bed frame.
Figure 15A:
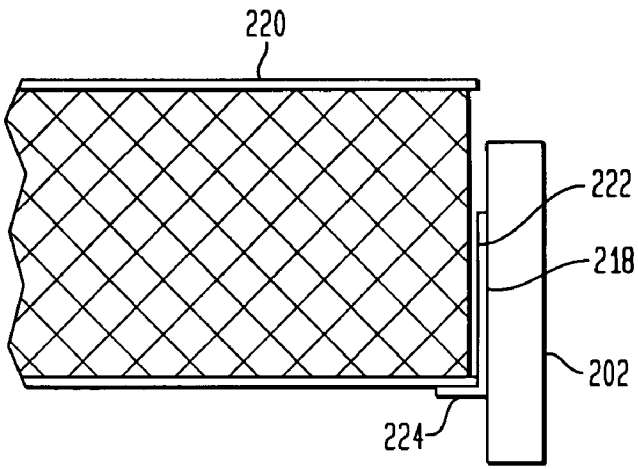

Turning now to FIGS. 15 and 15A, there is shown, respectively, an exploded view and a side view of another prior art system showing an alternate support bracket 218 that is used to affix a box spring 220 to a wooden side rail 202 in constructing a bed structure. As can be seen the one piece metal support bracket 218 basically comprises an upper vertical section 222 and a lower horizontal section 224 such that the upper vertical section has a plurality of screw holes 226 through which wood screws 228 can pass to screw the support bracket to the wooden side rail 202. Thus, referring specifically to FIG. 15A, the lower horizontal section 224 is adapted to underlie and support the box spring 220 and, obviously, a plurality of such support brackets 218 are used along the linear length of the wooden side rail 202.

Figure 16:
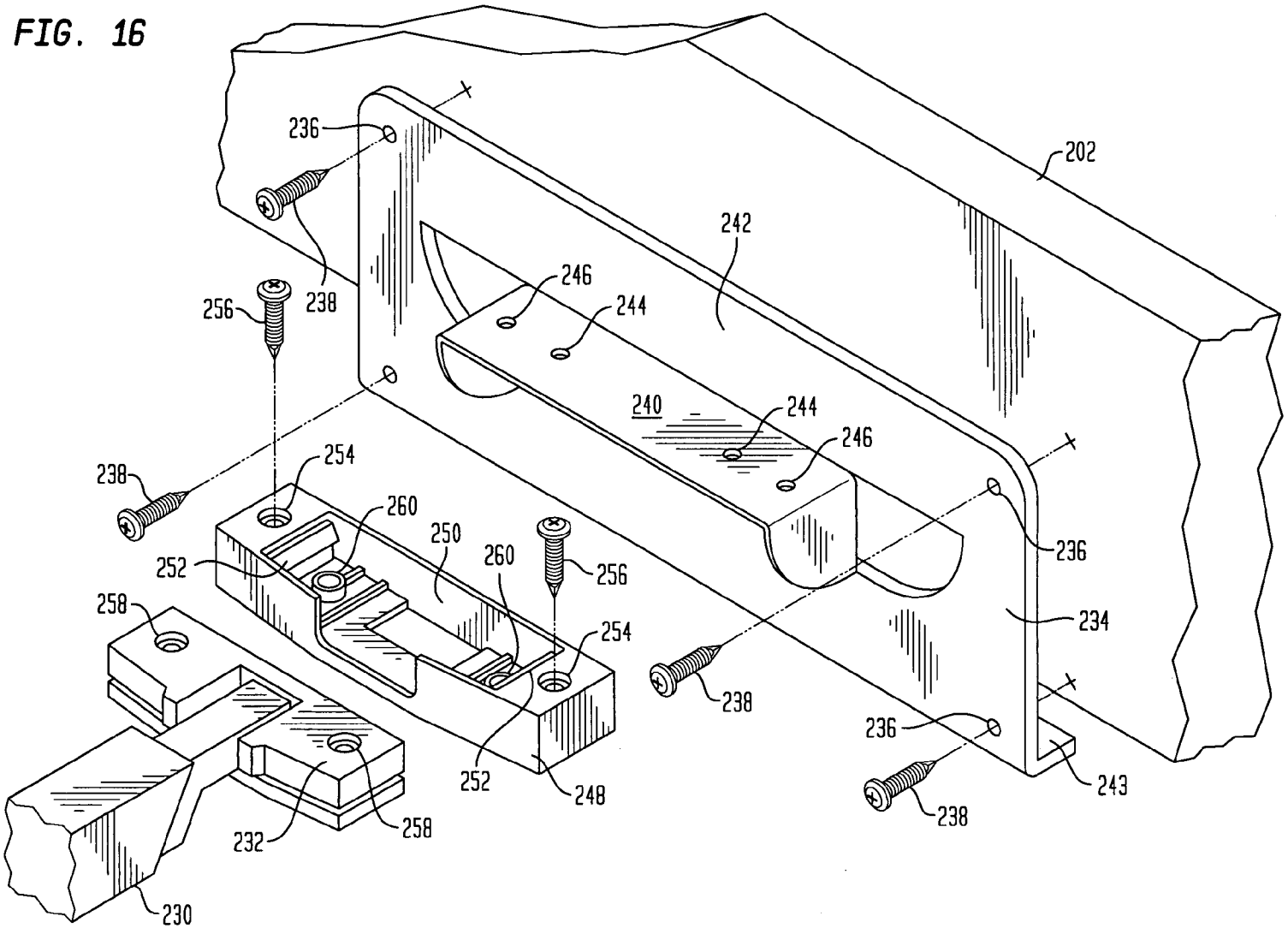
FIG. 16 is an exploded view of an affixation system with a stamped metal support bracket constructed in accordance with the present invention.

Next, in FIG. 16, there is shown an exploded view of a system to affix the universal cross member 230 to the wooden side rail 202 in accordance with the present invention. Thus, in the FIG. 16 embodiment, the universal cross member 230 has its slide end 232 adapted to be affixed to the wooden side rail 202 by means of a rail connector 248. In this embodiment, there is a stamped metal support bracket 234 having a plurality of screw holes 236 that enable wood screws 238 to be screwed into the wooden side rail 202 to secure the stamped metal support bracket 234 to the wooden side rail 202.

The stamped metal support bracket 234 is basically a stamped component and includes a horizontal shelf 240 that extends outwardly from a flat, planar body 242 that is mounted flush with the internal surface of the wooden side rail 202. A lower flange 243 extends out from the lower edge of the planar body 242 to underlie and provide support to the wooden side rail 202. There are also formed, a set of inner holes 244 and a set of outer holes 246 in the horizontal shelf 240 for a purpose that will be later explained.

As in the prior embodiments, there is also a rail connector 248 and which has a recessed interior section 250 having a pair of inwardly extending lips 252 therein that are generally flexible and which override and grasp the slide end 232 when it is inserted into the interior recessed section 250 of the stamped metal support bracket 234 in affixing the universal cross member 230 to the wooden side rail 202.

As also can be seen in FIG. 16, in the construction of the system, the rail connector 248 has a set of screw holes 254 that align with the outer holes 246 in the stamped metal support bracket 234 and a pair of metal screws 256 are used to secure the rail connector 248 to the horizontal shelf 240 of the stamped metal support bracket 234, thus affixing the rail connector 248 thereto.

Another set of screw holes 258 is provided in the slide end 232 in the event the consumer or assembler wants to affix the universal cross member 230 directly to the stamped metal support bracket 234 by means of the inner holes 244, or directly to a ledge that may be available on the wooden side rail 202. Alternatively, the screw holes 258 may be used to pass screws therethrough and also through the bosses 260 formed in the rail connector 248 in order to securely affix the universal cross member 230 to the wooden side rail 202 in the event any part of the rail connector 248 is broken.

Accordingly, with the affixation system of FIG. 16, the universal cross member 230 can be readily affixed to the wooden side rail 202 in a snap in manner and easily detached therefrom by inserting a bladed screwdriver to move the inwardly extending lips 252 away from their position retaining the slide end 232.

Figure 17:
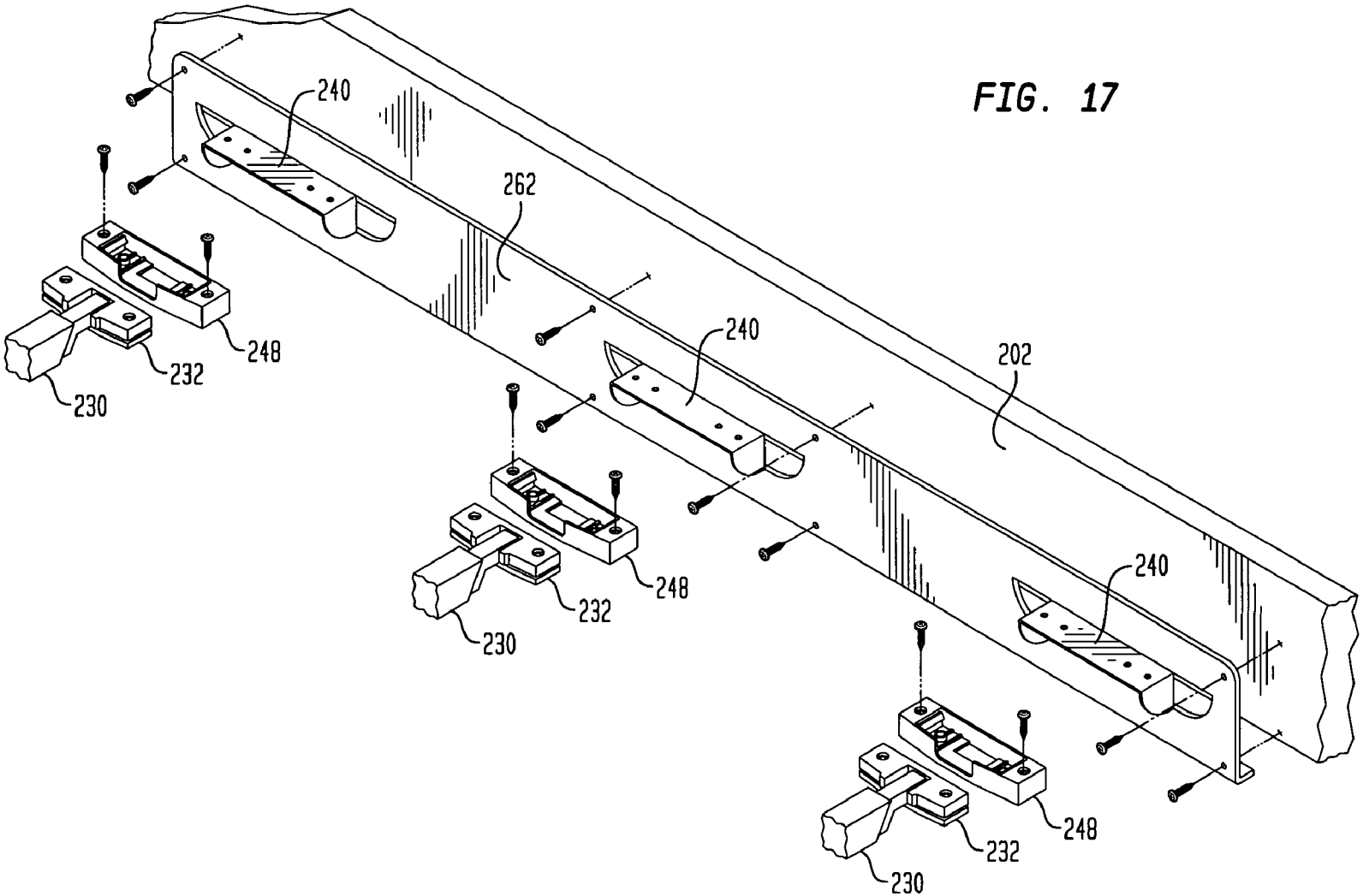
FIG. 17 is an exploded view of an elongated, multiple connection version of the stamped metal support bracket of FIG. 16.

Turning now to FIG. 17, taken along with FIG. 16, there is shown an exploded view of a system to affix the universal cross member 230 to the wooden side rail 202 by means of a multiple system using an elongated stamped metal support bracket 262 forming a plurality of horizontal shelves 240 in the same manner as with the construction of the individual horizontal shelf 240 of FIG. 16. As such the elongated stamped metal support bracket 262 not only provides receptacles for attaching a plurality of universal cross members 230, but it also provides additional support for the wooden side rail 202 to prevent the wooden side rail 202 from bowing downwardly under the weight of the box spring, mattress, and person(s) as well as strengthening the wooden side rail 202 from lateral flexing, that is, in and out bowing.

In addition, the use of an elongated stamped metal support bracket 262 with a plurality of receptacles for the universal cross member 230 avoids the problem of aligning up the various receptacles across the opposite wooden side rails since once the two elongated stamped metal support brackets are centered along the wooden side rails, the receptacles for receiving the universal cross members are automatically aligned and will match up such that the receptacles of one elongated stamped metal support bracket will be automatically aligned with the receptacles formed in the other elongated stamped metal support bracket.

Figure 18:
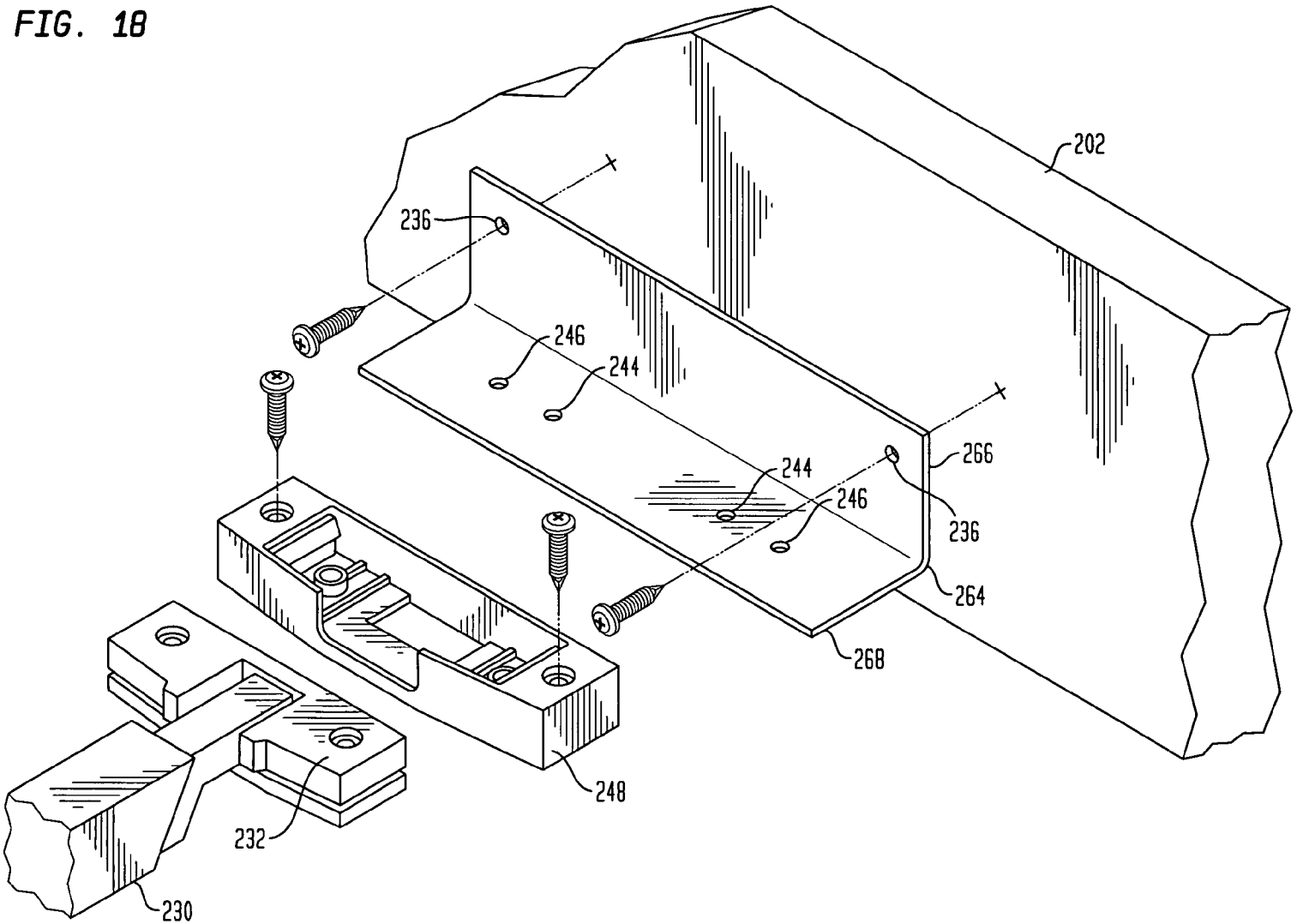
FIG. 18 is an enlarged exploded view of a further embodiment of an affixation system with a metal angle iron bracket constructed in accordance with the present invention.

Turning next to FIG. 18, there is shown an exploded view of a similar affixation system as shown in FIGS. 16 and 17, however in the embodiment shown in FIG. 18, there is an angle iron support bracket 264 that is used to affix the rail connector 248 to the wooden side rail 202. In other respects, the overall affixation system of FIG. 18 is similar to the prior embodiment of FIG. 16 and like numbers have been used to explain this embodiment. As can be seen, therefore, the angle iron support bracket 264 has a vertical leg 266 and a horizontal leg 268 and the screw holes 236 are formed in the vertical leg 266 to secure the angle iron support bracket 264 to the wooden side rail 202 and with the sets of inner holes 244 and outer holes 246 formed in the horizontal leg 268 of the angle iron support bracket.

In other respects, however, the construction and function of the FIG. 18 embodiment is the same as that described with respect to the FIG. 16 embodiment.

Figure 19:
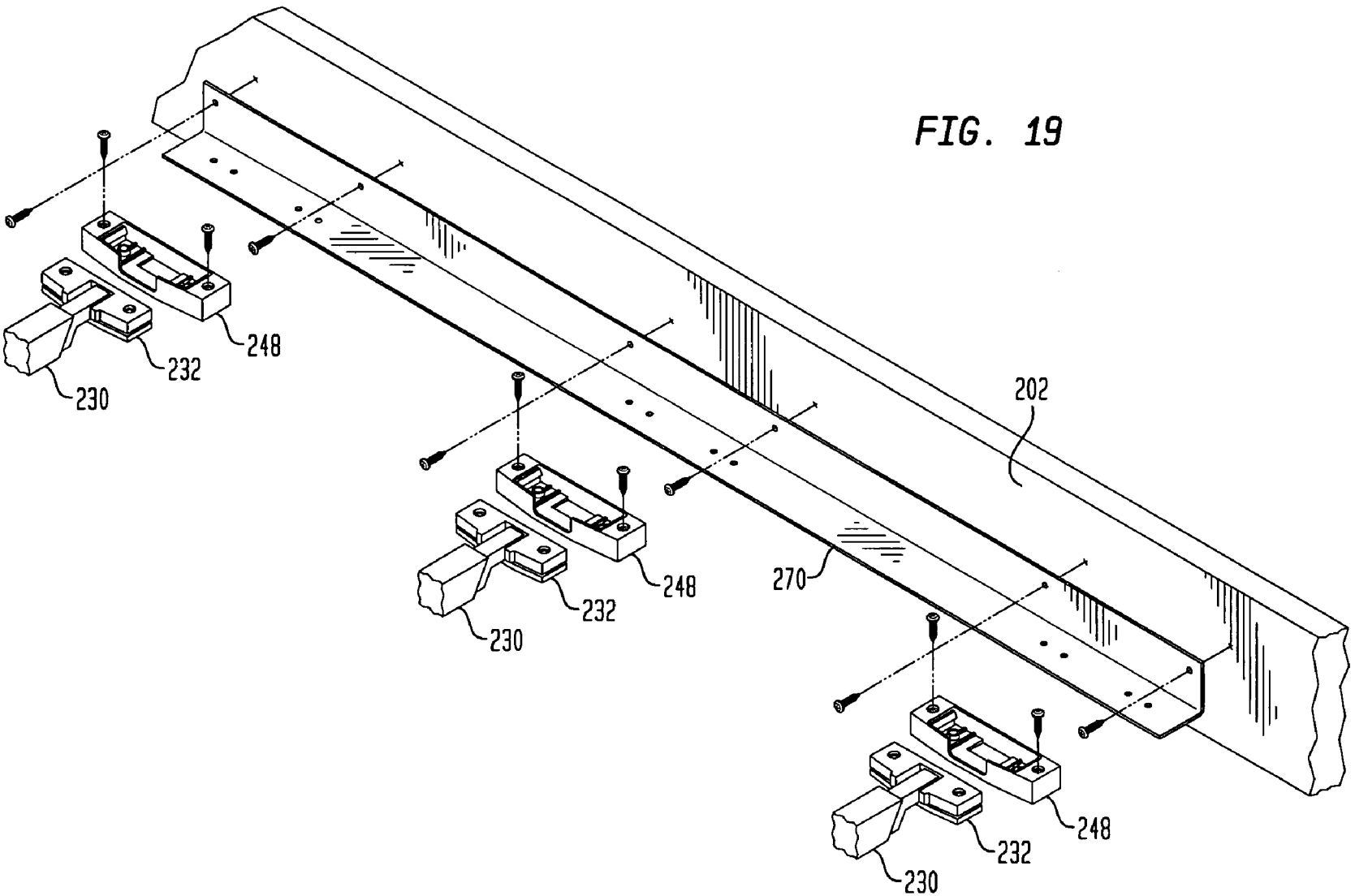
FIG. 19 is an exploded view of an elongated, multiple connection version of the metal angle iron bracket of FIG. 18.

Turning now to FIG. 19, taken along with FIG. 18, there is shown an exploded view of a system to affix the universal cross member 230 to the wooden side rail 202 by means of a multiple system using an elongated angle iron support bracket 270 locating a plurality of rail connectors 248 along the horizontal leg 268 in the same manner as with the construction of the individual site for a rail connector 248 of FIG. 18. Again, the elongated angle iron support bracket 270 not only provides receptacles for attaching a plurality of universal cross members 230, but it also provides additional support for the wooden side rail 202 to prevent the wooden side rail 202 from bowing downwardly under the weight of the box spring, mattress, and person(s) as well as to strengthen the wooden side rail 202 from inwardly and outwardly bowing.

Figure 20:
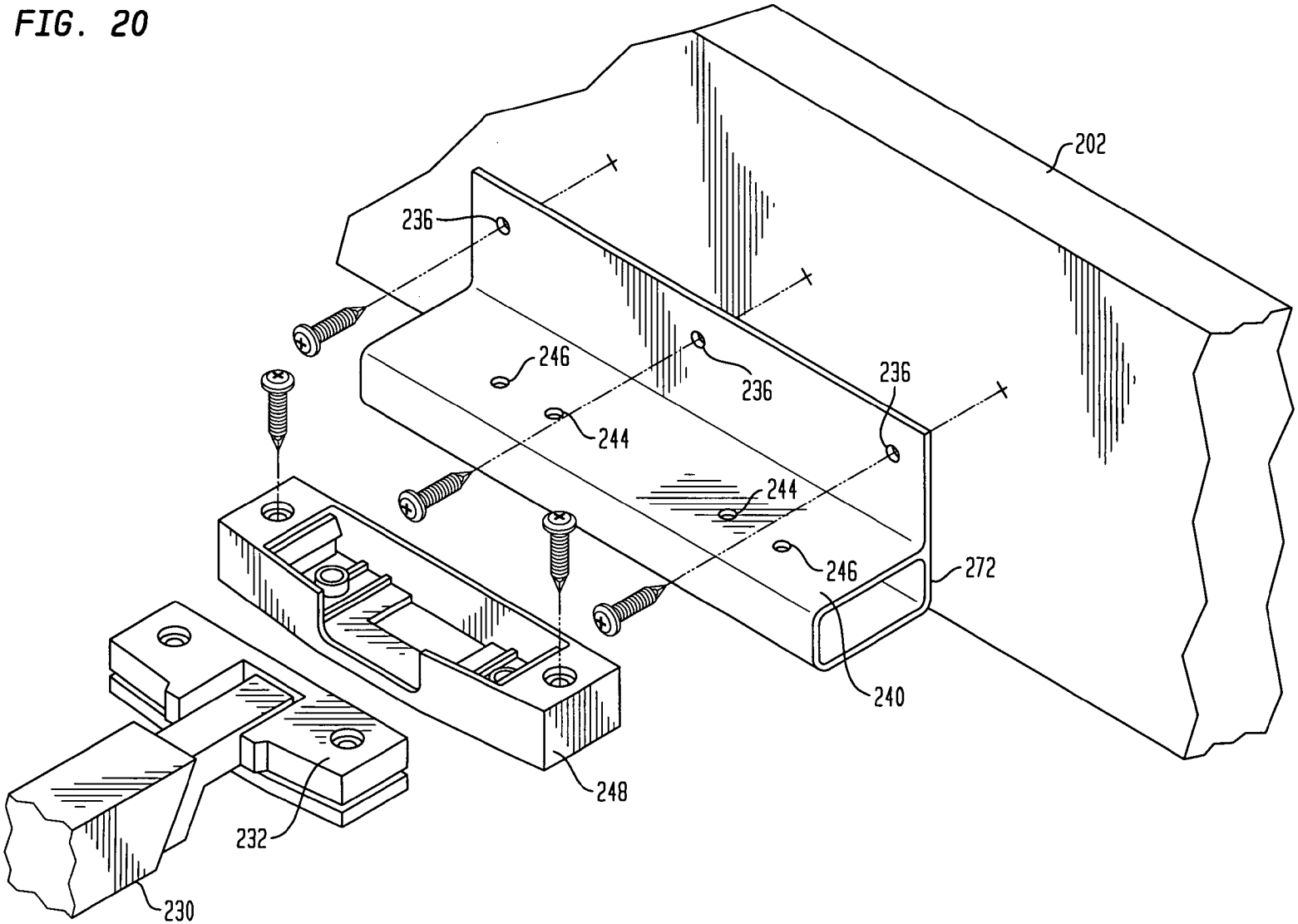
FIG. 20 is an enlarged exploded view of a further embodiment of a side rail affixation system using an extruded bracket of the present invention.

Turning next to FIG. 20, there is shown an exploded view of a similar affixation system as shown in FIGS. 16–19, however in the embodiment shown in FIG. 20, there is an extruded support bracket 272 that is used to affix the rail connector 248 to the wooden side rail 202. In other respects, the overall affixation system of FIG. 20 is similar to the prior embodiments of FIG. 16-19 and like numbers have been used to explain this embodiment. As can be seen, therefore, the extruded support bracket 272 can be formed of an aluminum extrusion forming a horizontal shelf 240 on which the rail connector 248 can be mounted as previously described.

Figure 21:
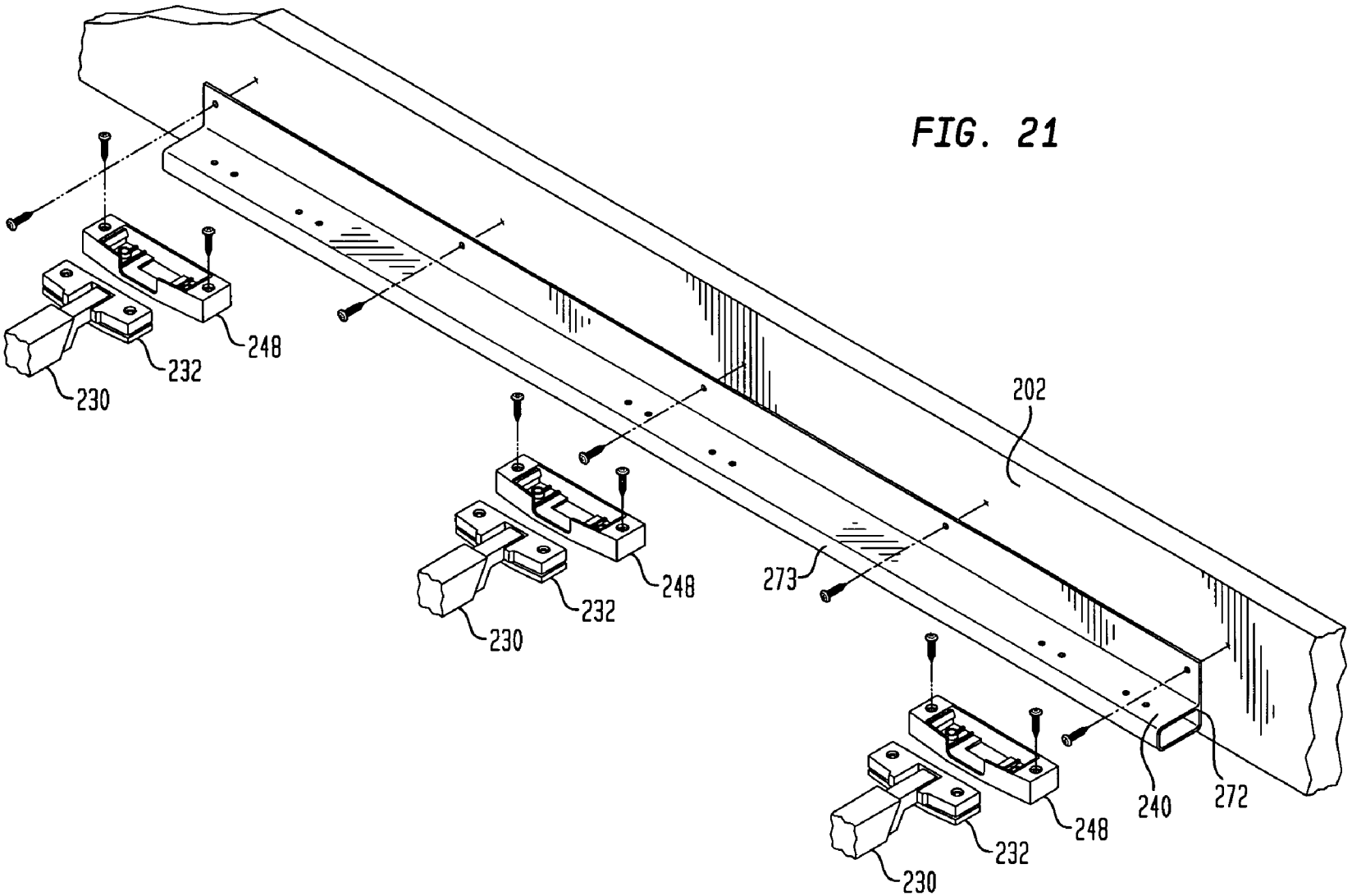
FIG. 21 is an exploded view of an elongated, multiple connection version of the extruded bracket of FIG. 20.

Turning now to FIG. 21, taken along with FIG. 20, there is shown an exploded view of a system to affix the universal cross member 230 to the wooden side rail 202 by means of a multiple system using an elongated extruded support bracket 273 locating a plurality of rail connectors 248 along the horizontal shelf 240 in the same manner as with the construction of the individual site for a rail connector 248 of FIG. 20. Again, the elongated extruded support bracket 273 acts to prevent the wooden side rail 202 from bowing downwardly under the weight of the box spring, mattress, and person(s).

Figure 22A:
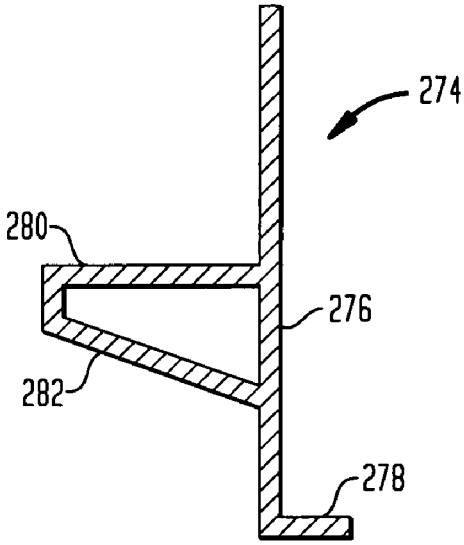
FIGS. 22A–22D are side, cross sectional views of various side rail support brackets usable with the present invention.
Figure 22B:
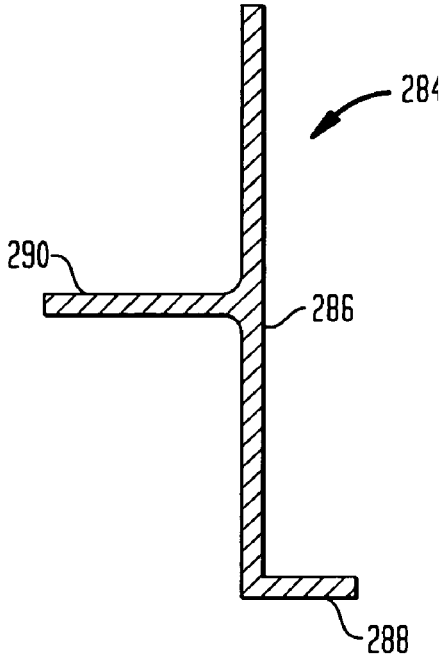
Figure 22C:
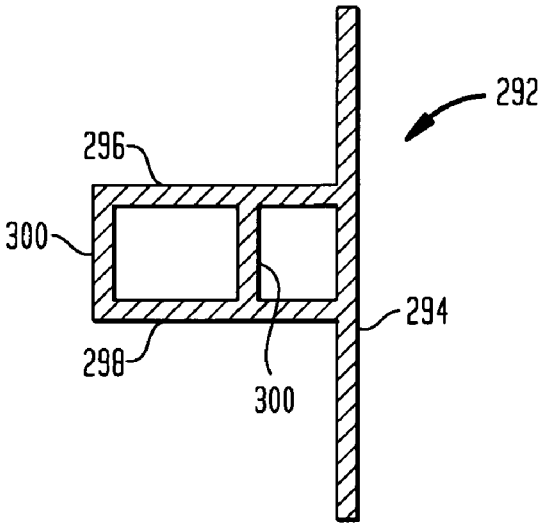

Turning now to FIGS. 22A–22D, there are shown cross sectional views of various support brackets that can be used in connection with the present invention and, in FIG. 22A the support bracket 274 has a vertical body 276 with a lower horizontal flange 278 that fits underneath a wooden side rail to abut thereagainst to provide alignment to the support bracket 274. There also a horizontal shelf 280 that is supported by a angled support section 282. In FIG. 11B, there is a further support bracket 284 comprising a vertical body 286 with a lower horizontal flange 288 and a cantilevered shelf 290 for supporting a rail connector. In FIG. 22C, there is a support bracket 292 having a vertical body 294 and a braced horizontal shelf 296 having a lower section 298 with vertical supports 300 therebetween.

Figure 22D:
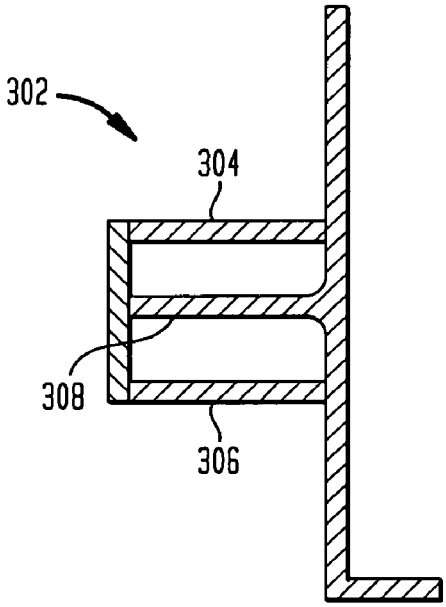

Lastly, in FIG. 22D, there is a support bracket 302 having a horizontal shelf 304 with a lower section 306 and a horizontal support 308 such that screws passing through the horizontal shelf 304 can gain additional stability by also passing though the horizontal support 308 but do not pass through that horizontal support 308 so as to not leave a sharp screw end to create a hazard extending outwardly from the support bracket 302.

Figure 23:
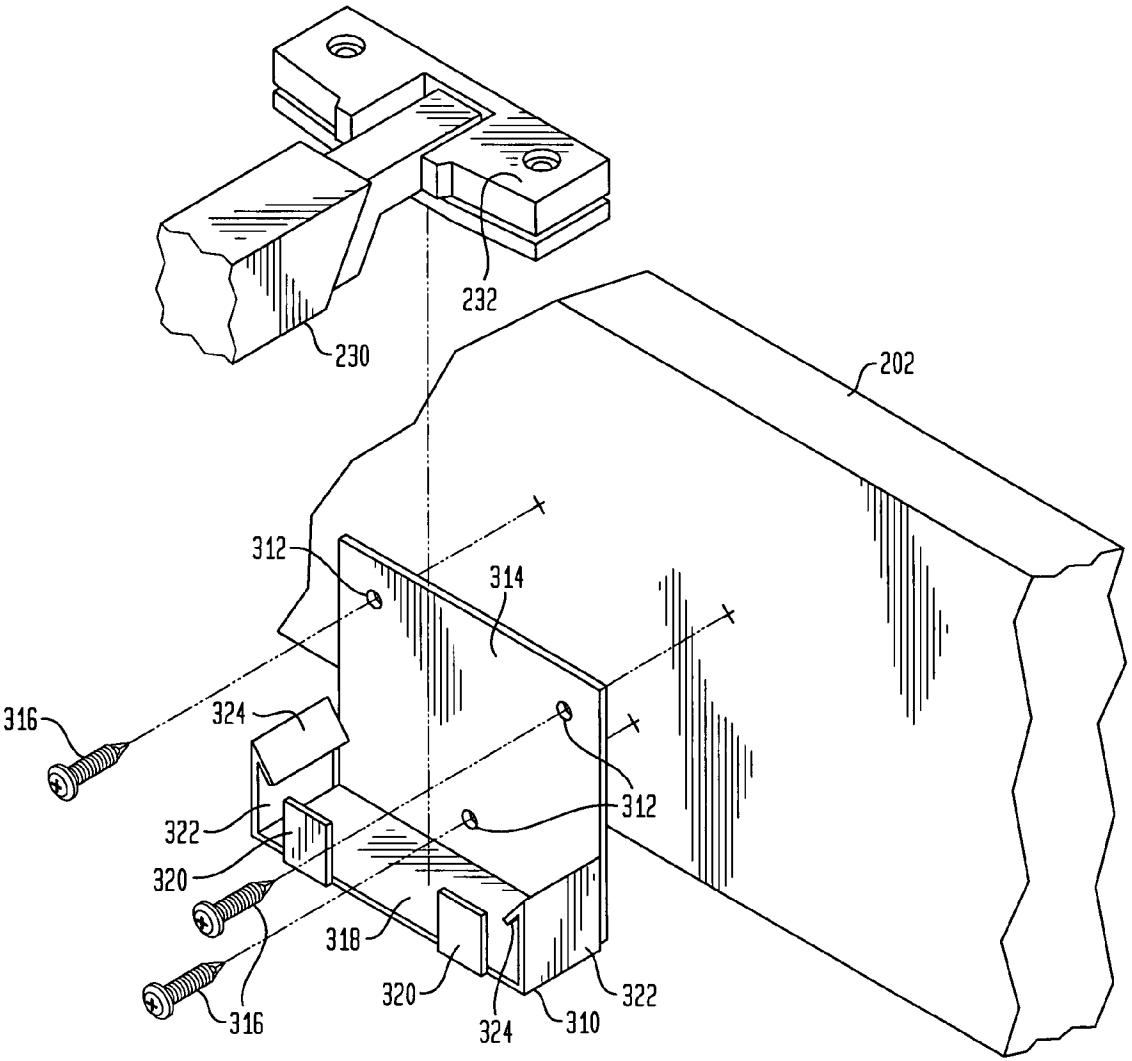
FIG. 23 is an enlarged, exploded view of a further embodiment of a side rail affixation system using a folded metal bracket of the present invention.

Turning now to FIG. 23, there is shown an exploded view of a folded metal bracket 310 that allows the slide end 232 of the universal support member 230 to directly be affixed to the wooden side rail 202, that is, without the use of an intermediate rail connector. In this embodiment, the folded metal bracket 310 has a plurality of screw holes 312 in the vertical body 314 so that wood screws 316 can be used to affix the folded metal bracket 310 directly to the wooden side rail 202.

The folded metal bracket 310 has a floor 318 to support the slide end 232 when affixed thereto and has, extending upwardly from the floor 318, front flanges 320 and side flanges 322 to basically surround the slide end 232. Each of the side flanges has an inwardly and downwardly directed tab 324 that fits over the upper surface of the slide end 232 when interfitted within the folded metal bracket 310 such that the slide end 232 is locked into the affixed position by the tabs 324. Again, to remove the universal cross member 230, a flat bladed screw driver can be inserted to pry the tabs 324 outwardly to release the slide end 232 from its affixed position locked to the folded metal bracket 310.

Figure 24:
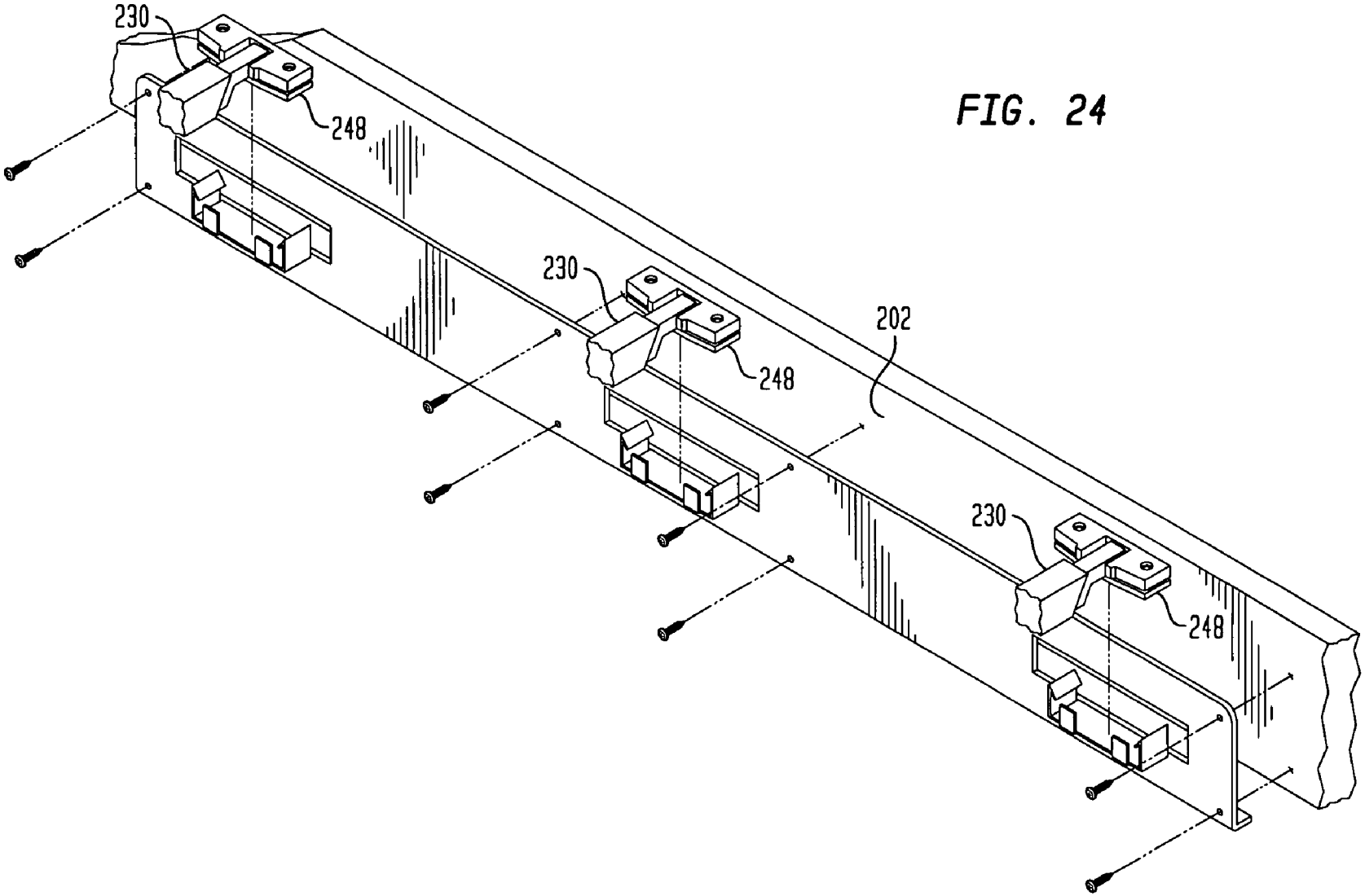
FIG. 24 is an exploded view of an elongated, multiple connection version of the folded metal bracket of FIG. 23.

Turning now, to FIG. 24, taken along with FIG. 23, there is shown an exploded view of a system to affix the universal cross member 230 to the wooden side rail 202 by means of a multiple system using an elongated folded metal bracket 326 having a plurality of locations to receive a slide end 232 of universal cross members 230 in the same manner as with the construction of the individual site for a sled end 232 of FIG. 23. Again, the elongated folded metal bracket 326 acts to prevent the wooden side rail 202 from bowing downwardly under the weight of the box spring, mattress, and person(s).

Accordingly, as can be seen the universal cross member of the present invention is universal in nature since it can be used with any height of the side rails above the floor, in excess of a minimum height, inasmuch as the universal cross member does not need support from that floor to carry the weight of the box spring and mattress and also, the universal cross member can be used in applications where an adjustment needs to be made for varying the span or width between the side rails.

While the present invention has been set forth in terms of a specific embodiment or embodiments, it will be understood that the universal cross member herein disclosed may be modified or altered bi those skilled in the art to other configurations. Accordingly, the invention is to be broadly construed and limited only by the scope and spirit of the claims appended hereto.

We claim:

1. A support system comprised of at least one deformable receptacle and a support system adapted to join two parallel sides (122) of a bed frame, each of the sides (122) having at least one deformable receptacle (82), said support system comprising a substantially straight member (66) having ends (76) adapted to be snapped into said receptacles (82) wherein the receptacles are deformed as said ends (76) are snapped into said receptacles to join the ends of the support system with the parallel sides (122) of a bed frame.

2. A support system as defined in claim 1 wherein said straight member (66) is a tubular metal member.

3. A support system as defined in claim 1 wherein said straight member (66) includes at least one telescoping bracket (72) extending outward from at least one of said ends of said straight member (66) to affix said straight member (66) to at least one of the receptacles (82) of the frame.

4. A support system as defined in claim 3 wherein said at least one telescoping bracket (72) includes a bracket (48) inwardly sloping in the downward direction.

5. A bed frame or bed rails for underlying and supporting a box spring, said bed frame comprising a pair of side rails (122) spaced apart and parallel to each other, at least one receptacle (82) located on each of said pair of side rails (122), a cross member (64) affixed to each of said side rails (122) and extending transversely therebetween, said cross member (64) comprising a straight member (66) having opposed end brackets (72) slidingly received in said opposed ends of said straight member (66), said end brackets (72) configured to be snap fitted within said receptacles (82) by causing deformation of the receptacles (82) as said end brackets (72) are snap fitted to the receptacles (82).

6. A bed frame or bed rails for underlying and supporting a box spring as defined in claim 5 wherein said straight member (66) includes a releasable securing means to secure said end brackets (72) to said straight member (66) to fix said end brackets (72) in a desired position at a desired length of said cross member (64).

7. A bed frame or bed rails for underlying and supporting a box spring as defined in claim 5 wherein said side rails (122) each have a receptacle bracket (82) adapted to receive and interfit with said end brackets (72) to affix said cross member (64) to said side rails (122).

8. A bed frame or bed rails for underlying and supporting a box spring as defined in claim 7 wherein said end brackets (72) comprise male portions tapered inwardly in the downward direction and said receptacle brackets on said side rails are female portions (52) having an inwardly tapered opening to mate with said male portions.

9. A bed frame or bed rails for underlying and supporting a box spring as defined in claim 7 wherein said side rails (122) include rail brackets having openings configured to receive the end brackets (72) of said straight member (64).

10. A bed rail construction comprising side rails (122) and at least one cross member (18) having ends, rail connectors (82) affixed to each of said side rails (122) adapted to receive said ends of said at least one cross member (18), said rail connector (82) having a pair of flexible tabs (126) adapted to capture said ends of said cross member (18) when said ends are received in said rail connector (82).

11. A bed rail construction as defined in claim 10 wherein said ends of said at least one cross member (18) comprise lateral side surfaces formed in the configuration of upwardly shaped wedges.

12. A bed rail construction as defined in claim 11 wherein flexible tabs (126) are adapted to flex as said upwardly shaped wedges are received in said rail connectors (82) and said flexible tabs (126) have inwardly extending lips (128) adapted to capture said upwardly shaped wedges when said ends of said at least one cross member are received in said rail connectors (82).

13. A bed rail construction as defined in claim 10 wherein said side rails (122) have a horizontal surface having an opening (87) therein and wherein said rail connector (82) includes a similar shaped opening and further includes a flexible plug (85) adapted to be inserted through said opening (87) in said side rail connector (82) and said opening (87) in said side rail (122), said ends of said at least one cross member (18) having downwardly facing tabs (144) that interfit into said plug (85) when said ends of said at least one cross member (18) is received in said rail connectors (82).

14. A bed rail construction as defined in claim 13 wherein said plug (85) has a barb (146) adapted to retain said plug (85) to said side rail (10) when said downwardly facing tabs (144) of said ends of said at least one cross member (18) are inter-fitted into said plug (85).

15. A system for connecting a cross member (18) of a bed assembly to a side rail (10), said cross member having a molded end housing (76), a rail connector (82) affixed to said side rail and having a receptive fitting to receive said molded end housing (76), said molded end housing (76) being molded of a shape to be manually snapped onto said rail connector (82) causing deformation of the rail connector to be firmly affixed thereto without the use of tools.

16. A system for connecting a cross member (18) of a bed assembly to a side rail as defined in claim 15 wherein said molded end housing (76) includes upwardly directed wedge shaped ends adapted to fit into said rail connector.

17. A system for connecting a cross member (18) of a bed assembly to a side rail as defined in claim 15 wherein said rail connector (82) includes flexible tabs (126) that interfit with said upwardly directed wedge shaped ends to retain said cross member (18) affixed to said side rail.

18. A system for connecting a cross member (18) of a bed assembly to a side rail (10) as defined in claim 15 wherein said side rail (10) has an opening and said rail connector has an opening (87) adapted to be aligned with said opening in said side rail (10), said system further includes a flexible plug (85) adapted to be inserted through both said opening in said rail connector (87) and said opening in said side rail (10), and wherein said molded end housing (76) has a downwardly facing tab (144) adapted to enter said flexible plug (85) to retain said plug in said position inserted through both said opening said rail connector (87) and said opening in said side rail (10).

19. A system for connecting a cross member (18) of a bed assembly to a side rail (10) as defined in claim 18 wherein said plug (85) further comprises a lip (146) extending outwardly therefrom and adapted to lock with said opening (87) in said side rail (10) to affix said plug (85) in position inserted through both said opening said rail connector (87) and said opening in said side rail.

20. A system for connecting a cross member (18) of a bed assembly to a side rail (10) as defined in claim 15 wherein said rail connector (82) is affixed to said side rail by means of metal clips (136).

21. A system for connecting a cross member (18) of a bed assembly to a side rail (10) as defined in claim 15 wherein said side rail (10) is a wooden side rail (122) and said rail connector (82) is affixed to affixed to said side rail (10) by means of screws (125).

22. A system for connecting a cross member (18) of a bed assembly to a side rail (10), said cross member (18) having outer ends (76), a rail connector (82) affixed to said side rail (10) and having a receptive fitting to receive said outer end (76) of said cross member(18), said outer end (76) being configured to be manually snapped into said rail connector (82) by deforming the rail connector (82) to be firmly affixed thereto.

23. A system as defined in claim 22 wherein said outer ends (76) of said cross member (18) comprise molded ends.

24. The system as defined in claim 22 wherein said side rail is a wooden side rail (202) and said rail connector (248) is affixed to said side rail by means of a stamped metal support bracket (234) that is affixed to said side rail (10).

25. The system as defined in claim 24 wherein said stamped metal support bracket (234) has a plurality of screw holes (236) and is affixed to said wooden side rail (202) by wood screws (238) passing through said screw holes (236).

26. The system as defined in claim 24 wherein said stamped metal support bracket (262) is an elongated support adapted to have a plurality of rail connector (248) mounted along the linear length of said side rail (202).

27. The system as defined in claim 22 wherein said side rail is a wooden side rail (202) and said rail connector (248) is affixed to said side rail (202) by means of an angle iron bracket (264) having a vertical leg (266) and a horizontal leg (268).

28. The system as defined in claim 27 wherein said vertical leg (266) of said angle iron bracket (264) is affixed to said side rail (202) and said rail connector (248) is affixed to said horizontal leg (268) of said angle iron.

29. The system as defined in claim 28 wherein said side rail is a wooden side rail (202) and said vertical leg (266) has a plurality of screw holes (236) and said angle iron bracket (266) is affixed to said wooden side rail (202) by wood screws passing through said screw holes (236).

30. The system as defined in claim 28 wherein said angle iron bracket is an elongated angle iron bracket (270) adapted to have a plurality of rail connectors (248) mounted along the linear length of said side rail (202).

31. The system as defined in claim 22 wherein said side rail is a wooden side rail (202) and said rail connector is affixed to said side rail by means of an extruded metal bracket (272) that is affixed to said side rail (202).

32. The system of claim 31 wherein said extruded metal bracket (272) has a vertical body having a plurality of screw holes (236) and a horizontal ledge (240) extending therefrom and wherein said extruded metal bracket (272) is affixed to said wooden side rail (202) by wood screws passing through said screw holes (236) and said rail connector (248) is affixed to said horizontal ledge (240) of said extruded metal bracket (272).

33. The system as defined in claim 32 wherein said extruded metal bracket is an elongated extruded metal bracket (273) adapted to have a plurality of rail connectors (248) mounted along the linear length of said elongated extruded metal bracket (273).

34. A system for connecting a cross member of a bed assembly to a side rail, said cross member having an outer end (232), a folded metal bracket (310) affixed to said side rail (202), said folded metal bracket (310) having a receptive fitting to receive said outer end (232), said outer end (232) being configured to be manually snapped into said folded metal bracket (310) by deforming the folded metal bracket to be firmly affixed thereto.

35. The system of claim 34 wherein said receptive fitting comprises a bottom surface (318) and a pair of side flanges (322), each of said side flanges (322) having an inwardly and downwardly directed tab (324), said tabs (324) adapted to overlie and snap fit against said outer end (232) when said outer end (232) is affixed to said folded metal bracket (310).

36. The system of claim 35 wherein said side rail is a wooden side rail (202) and said folded metal bracket (310) has a vertical body (314) having a plurality of screw holes (312) and wherein said folded metal bracket (310) is affixed to said side rail (202) by means of screws (316) passing through said screw holes (312).

37. The system as defined in claim 36 wherein said folded metal bracket is an elongated folded metal bracket (326) adapted to have a receptive fittings formed along the linear length of said elongated folded metal bracket (326).

* * * * *